US011059621B2

(12) United States Patent
Nowak et al.

(10) Patent No.: US 11,059,621 B2
(45) Date of Patent: Jul. 13, 2021

(54) CONTAINER WITH AT LEAST ONE COMPARTMENT

(71) Applicant: Graphic Packaging International, LLC, Atlanta, GA (US)

(72) Inventors: Lee Nowak, Leicestershire (GB); Kate Jackson, Leicestershire (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 16/528,981

(22) Filed: Aug. 1, 2019

(65) Prior Publication Data

US 2020/0039680 A1 Feb. 6, 2020

Related U.S. Application Data

(60) Provisional application No. 62/714,976, filed on Aug. 6, 2018.

(51) Int. Cl.
*B65D 5/20* (2006.01)
*B65D 5/66* (2006.01)
(Continued)

(52) U.S. Cl.
CPC ..... *B65D 5/2076* (2013.01); *B65D 5/4266* (2013.01); *B65D 5/48022* (2013.01); *B65D 5/6667* (2013.01)

(58) Field of Classification Search
CPC ..... B65D 5/2076; B65D 5/4266; B65D 5/48022; B65D 5/6667; B65D 5/48002; B65D 81/32; B65D 31/12; B65D 3/24; B65D 5/3657; B65D 77/04; A47G 21/001
USPC ..... 229/100, 120.18, 904, 120.08, 186, 407, 229/114, 120.02, 72, 902; D9/761; D7/553.2, 602; 206/557, 561; 220/557, 220/720; 383/40; 99/449
See application file for complete search history.

(56) References Cited

U.S. PATENT DOCUMENTS 662,969 A 12/1900 Roth
978,569 A 12/1910 Elkin
(Continued)

FOREIGN PATENT DOCUMENTS

CA 2 586 472 5/2006
DE 75 23 198 11/1975
(Continued)

OTHER PUBLICATIONS

Hot Dog betaboard Box used for serving hot dog burgers and chips. [online] Published May 29, 2016. Retrieved Aug. 27, 2018 from URL: http://www.packagingbiodegradable.com.au/home/1033-hot-dog-clam-ec-brown--400-pcs.html.
(Continued)

*Primary Examiner* — Christopher R Demeree
(74) *Attorney, Agent, or Firm* — Womble Bond Dickinson (US) LLP

(57) ABSTRACT

A container for holding one or more articles includes a plurality of panels for extending at least partially around an interior of the container. The plurality of panels includes a front panel, a back panel, at least one side panel, a bottom panel, and a divider panel separably connected to a panel of the plurality of panels. The divider panel is pivotable relative to the panel of the plurality of panels to define a compartment in the interior of the container.

55 Claims, 23 Drawing Sheets

(51) Int. Cl.
*B65D 5/4805* (2006.01)
*B65D 5/42* (2006.01)

(56) References Cited

U.S. PATENT DOCUMENTS 1,048,577 A 12/1912 Pardoe
1,516,090 A 11/1924 Gary et al.
1,651,848 A 12/1927 Stevens
1,667,376 A 4/1928 Fehrenkamp
1,814,561 A 7/1931 Krumm
1,824,862 A 9/1931 Young
2,054,596 A 9/1936 Ford
2,091,126 A 8/1937 Speer
2,100,888 A 11/1937 Vine
2,107,946 A 2/1938 Inman
2,132,966 A 11/1938 O'Brien
2,180,808 A 11/1939 Jacobstein et al.
2,194,220 A 3/1940 Elder
2,312,595 A 3/1943 Smith
2,337,654 A 12/1943 Goodyear
2,345,000 A 3/1944 Newsom
2,363,861 A 11/1944 Goodyear
2,565,146 A 8/1951 Okon
2,583,915 A 1/1952 Whitley
2,769,971 A 6/1954 Goldberg
2,804,252 A 8/1957 Nute
2,833,458 A 5/1958 Toensmeier
2,844,294 A 7/1958 Williams
2,852,177 A 9/1958 Frasch
2,862,612 A 12/1958 Brown
2,877,736 A 3/1959 Simmons
2,924,371 A 2/1960 Frankenstein
2,924,372 A 2/1960 Kirkeby
2,955,733 A 10/1960 Wilson
2,967,610 A 1/1961 Ebert
3,003,584 A 10/1961 Coe
3,071,882 A 1/1963 Eisman et al.
3,099,381 A 7/1963 Meyers
3,107,039 A 10/1963 Painter
3,142,430 A 7/1964 Meyers
3,146,933 A 9/1964 Moore
3,181,770 A 1/1965 Coe
3,189,247 A 6/1965 Wischusen
3,204,814 A 9/1965 Mahon
3,205,603 A 9/1965 Brumley
3,240,419 A 3/1966 Spiering et al.
3,324,998 A 6/1967 Farquhar
3,366,303 A 1/1968 Kaspar
3,499,595 A 3/1970 Brooks
3,515,331 A 6/1970 Guthrie
3,637,130 A 1/1972 Farquhar
3,692,228 A 9/1972 Spiege
3,721,380 A * 3/1973 Meyers ..... B65D 5/28 229/120.17
3,809,310 A 5/1974 VanderLugt, Jr.
3,876,131 A 4/1975 Tolaas
3,899,119 A 8/1975 Roccoforte
3,907,195 A 9/1975 Struble
3,958,744 A 5/1976 Herglotz
4,004,691 A 1/1977 Wihksne
4,008,849 A 2/1977 Baber
4,039,120 A 8/1977 Herzog
4,076,168 A 2/1978 Ferri
4,088,262 A 5/1978 Kuehlhorn
4,105,155 A 8/1978 Forbes, Jr.
4,126,261 A 11/1978 Cook
4,185,764 A 1/1980 Cote
4,228,945 A 10/1980 Wysocki
4,252,264 A 2/1981 Herbst et al.
4,278,197 A 7/1981 Scheinbaum et al.
4,313,542 A 2/1982 Roberts et al.
4,472,896 A 9/1984 Brauner et al.
4,477,014 A 10/1984 Brandenburger
4,492,333 A 1/1985 Roberts
4,530,459 A 7/1985 Maroszek
4,562,916 A 1/1986 Mode
4,572,423 A 2/1986 Spencer
4,592,914 A 6/1986 Kuchenbecker
D287,464 S 12/1986 Mode
4,630,733 A 12/1986 Fear
4,684,023 A 8/1987 Cortopassi
4,705,173 A 11/1987 Forbes, Jr.
4,711,389 A 12/1987 Alba et al.
4,714,190 A 12/1987 Morrocco
4,757,937 A 7/1988 Maio et al.
4,775,771 A 10/1988 Pawlowski et al.
4,798,323 A 1/1989 Platt
4,804,133 A 2/1989 Kiyokane
4,804,137 A 2/1989 Harby
4,815,609 A 3/1989 Kiedaisch
4,865,921 A 9/1989 Hollenberg et al.
4,890,439 A 1/1990 Smart
4,895,259 A 1/1990 Paley
4,901,457 A 2/1990 Chandler
4,915,235 A 4/1990 Roosa
4,919,785 A 4/1990 Willey et al.
4,936,935 A 6/1990 Beckett
4,944,451 A 7/1990 Forbes, Jr.
4,955,528 A 9/1990 Schluckebier
4,963,424 A 10/1990 Beckett
4,993,625 A 2/1991 Stease et al.
5,034,234 A 7/1991 Andreas et al.
5,039,364 A 8/1991 Beckett et al.
5,047,710 A 9/1991 Mahoney
D320,743 S 10/1991 Alexander et al.
5,058,803 A 10/1991 Gulliver
5,071,062 A 12/1991 Bradley et al.
5,078,273 A 1/1992 Kuchenbecker
5,093,364 A 3/1992 Richards
5,096,723 A 3/1992 Turpin
5,117,078 A 5/1992 Beckett
RE33,979 E 6/1992 Cortopassi
5,118,033 A 6/1992 Kula
5,175,404 A 12/1992 Andreas et al.
5,205,474 A 4/1993 Stuart et al.
5,213,902 A 5/1993 Beckett
5,221,419 A 6/1993 Beckett
5,260,537 A 11/1993 Beckett
5,266,386 A 11/1993 Beckett
5,266,763 A 11/1993 Colombo
D342,446 S 12/1993 Parker et al.
5,300,748 A 4/1994 Colombo
D346,552 S 5/1994 Krupa
5,328,089 A 7/1994 Forbes, Jr.
RE34,683 E 8/1994 Maynard et al.
5,338,921 A 8/1994 Maheux et al.
5,340,436 A 8/1994 Beckett
5,354,973 A 10/1994 Beckett
5,358,176 A 10/1994 Rigby
D353,091 S 12/1994 Mumford
5,402,889 A 4/1995 Hermann et al.
5,402,931 A 4/1995 Gulliver et al.
5,410,135 A 4/1995 Pollart et al.
5,424,517 A 6/1995 Habeger, Jr. et al.
5,458,283 A 10/1995 Southwell et al.
5,464,150 A 11/1995 Porres Sanchez et al.
D365,272 S 12/1995 Krupa et al.
5,484,100 A 1/1996 Rigby
5,503,324 A 4/1996 Bacchetti et al.
5,510,132 A 4/1996 Gallo, Jr.
5,519,195 A 5/1996 Keefer et al.
D370,412 S * 6/1996 Rohrer ..... D7/602
D372,968 S * 8/1996 White ..... D23/386
D373,081 S * 8/1996 Bridger ..... D9/761
5,542,536 A 8/1996 Sutherland
5,582,345 A 12/1996 Lankhuijzen
5,585,027 A 12/1996 Young
5,626,283 A 5/1997 Mellon
5,628,921 A 5/1997 Beckett
5,630,544 A * 5/1997 Shane ..... B65D 31/12 229/117.06
5,662,265 A 9/1997 Jensen
5,672,407 A 9/1997 Beckett
5,688,427 A 11/1997 Gallo, Jr.

(56) References Cited

U.S. PATENT DOCUMENTS 5,690,273 A 11/1997 Jensen
5,697,549 A 12/1997 Yocum
5,704,483 A 1/1998 Groh
5,707,004 A 1/1998 Cai
5,720,429 A * 2/1998 Cordle ..... A47G 21/001 229/120.18
5,726,426 A 3/1998 Davis et al.
5,735,454 A 4/1998 Jensen
5,759,422 A 6/1998 Schmelzer et al.
5,788,081 A 8/1998 Bates
5,800,724 A 9/1998 Habeger et al.
5,826,781 A 10/1998 Jensen
5,871,145 A 2/1999 Hermann et al.
5,875,957 A * 3/1999 Yocum ..... B65D 5/48024 229/120.22
5,890,648 A 4/1999 Cai
5,938,110 A 8/1999 Bernstein
6,027,018 A 2/2000 Yocum
6,041,997 A 3/2000 Jensen
6,050,482 A 4/2000 Cai
6,053,403 A 4/2000 Cai
6,063,415 A 5/2000 Walters
6,068,181 A 5/2000 Cai
6,095,408 A 8/2000 Nguyen
6,102,568 A 8/2000 Davis
6,114,679 A 9/2000 Lai
6,119,930 A 9/2000 Lunstra et al.
6,150,646 A 11/2000 Lai et al.
6,182,890 B1 2/2001 Sattler et al.
6,204,492 B1 3/2001 Zeng et al.
6,216,946 B1 4/2001 Cai
6,251,451 B1 6/2001 Zeng
6,283,364 B1 9/2001 Gray, Sr.
D448,990 S 10/2001 Sorensen et al.
6,349,874 B1 * 2/2002 Hill ..... B65D 5/3614 229/120.18
6,386,443 B1 5/2002 Szczerbinski
D458,127 S 6/2002 de Groote
6,401,927 B1 6/2002 Sorensen et al.
D460,691 S 7/2002 Morris et al.
6,414,290 B1 7/2002 Cole et al.
6,419,153 B1 * 7/2002 Maita ..... B65D 81/32 220/23.4
6,433,322 B2 8/2002 Zeng et al.
6,440,050 B1 8/2002 Capparelli
6,455,827 B2 9/2002 Zeng
6,471,119 B2 10/2002 Cai
D467,499 S 12/2002 Garza et al.
D467,797 S 12/2002 Sullivan
6,527,123 B1 3/2003 Ausaf
D473,787 S 4/2003 Jones, Jr. et al.
6,552,315 B2 4/2003 Zeng et al.
6,561,414 B1 5/2003 Cai
6,568,586 B1 5/2003 VanEsley
6,634,547 B2 10/2003 Willis
D484,043 S 12/2003 Hwang et al.
6,677,563 B2 1/2004 Lai
6,681,983 B2 1/2004 Bill-Moore
6,683,289 B2 1/2004 Whitmore et al.
6,695,202 B2 2/2004 Miess
6,705,514 B2 * 3/2004 Pellati ..... B65D 5/008 229/116
6,717,121 B2 4/2004 Zeng et al.
6,719,190 B2 4/2004 Yocum
6,744,028 B2 6/2004 Chisholm et al.
6,765,182 B2 7/2004 Cole et al.
6,851,603 B1 2/2005 Carlson et al.
6,866,189 B2 3/2005 Nelson
6,892,932 B2 5/2005 Correll
6,966,483 B2 11/2005 Manninen
6,988,614 B2 1/2006 Hemmingway et al.
7,004,314 B2 2/2006 Pucillo et al.
7,007,837 B2 3/2006 Correll
7,019,271 B2 3/2006 Wnek et al.
D532,690 S 11/2006 Oliveira
7,140,532 B2 11/2006 Holt et al.
7,159,760 B2 1/2007 Pluck et al.
7,182,242 B2 2/2007 Cai
7,232,055 B1 6/2007 Lim
7,273,162 B2 9/2007 Baker
D555,513 S * 11/2007 Baker ..... D9/761
7,293,695 B2 11/2007 Stier
7,323,699 B2 1/2008 Hopkins et al.
7,364,064 B2 4/2008 Kanamori et al.
7,365,292 B2 4/2008 Cole et al.
7,414,230 B2 8/2008 Fitzwater
7,473,875 B2 1/2009 Fitzwater
7,484,653 B2 2/2009 Hirtado et al.
7,514,659 B2 4/2009 Lafferty
7,562,808 B1 7/2009 Philips
7,565,997 B1 7/2009 Lim
7,617,969 B2 11/2009 Oliveira
7,621,439 B2 11/2009 McClure
7,652,233 B2 1/2010 Keefe
7,667,167 B2 2/2010 Fitzwater
D622,139 S 8/2010 Marcott
D631,743 S 2/2011 Hubbard, Jr.
7,893,389 B2 2/2011 Fitzwater
7,938,267 B2 5/2011 Cross
7,982,167 B2 7/2011 Fitzwater
8,006,893 B2 8/2011 Burke et al.
8,056,799 B2 11/2011 Burke et al.
8,309,896 B2 11/2012 Fitzwater
8,474,641 B2 * 7/2013 Hays ..... A47G 19/2288 220/23.89
8,523,049 B2 9/2013 Fitzwater
D695,608 S 12/2013 Pusta
8,814,033 B2 8/2014 House
9,078,296 B2 7/2015 Fitzwater
D752,429 S 3/2016 Mayer
9,278,774 B2 3/2016 Fairchild, Jr.
D753,994 S 4/2016 Pantelleria
9,346,234 B2 5/2016 Hajek et al.
9,376,231 B2 6/2016 Pinkstone
D762,468 S 8/2016 Pantelleria
D769,114 S 10/2016 Montemayor
9,499,296 B2 11/2016 Mills et al.
9,540,135 B2 1/2017 Robertson
D842,095 S 3/2019 Hajek
2002/0108504 A1 8/2002 Cai
2003/0047595 A1 3/2003 Bill-Moore
2003/0080120 A1 5/2003 Whitmore et al.
2003/0106926 A1 6/2003 Beatificato et al.
2003/0206997 A1 11/2003 Winkelman et al.
2004/0074953 A1 4/2004 Yocum
2004/0089656 A1 5/2004 Watkins
2004/0101605 A1 5/2004 Sigel
2004/0159698 A1 8/2004 Tallevi et al.
2005/0045708 A1 3/2005 Bodary et al.
2005/0284865 A1 12/2005 Fogle et al.
2006/0016863 A1 1/2006 Holt et al.
2006/0042989 A1 3/2006 Suter
2006/0049190 A1 3/2006 Middleton
2006/0096978 A1 5/2006 Lafferty et al.
2006/0113300 A1 6/2006 Wnek et al.
2006/0186044 A1 8/2006 Baker
2006/0278521 A1 12/2006 Stowell
2007/0074993 A1 4/2007 Philips
2007/0131742 A1 6/2007 Fitzwater
2007/0131743 A1 6/2007 Fitzwater
2007/0131744 A1 6/2007 Fitzwater
2007/0131745 A1 6/2007 Fitzwater
2007/0138247 A1 6/2007 Fitzwater
2007/0251942 A1 11/2007 Cole et al.
2007/0251943 A1 11/2007 Wnek et al.
2007/0267467 A1 11/2007 Burke et al.
2007/0267468 A1 11/2007 Burke et al.
2007/0275130 A1 11/2007 Cole et al.
2008/0000897 A1 1/2008 Robbins et al.
2008/0047958 A1 2/2008 Cole et al.
2008/0078759 A1 4/2008 Wnek et al.
2008/0081095 A1 4/2008 Cole et al.
2008/0156859 A1 7/2008 Glasgow

(56) References Cited

U.S. PATENT DOCUMENTS

| | | | |
|---|---|---|---|
| 2008/0179385 | A1 | 7/2008 | Nikolai et al. |
| 2008/0290149 | A1 | 11/2008 | Sweet |
| 2008/0308614 | A1 | 12/2008 | Fitzwater |
| 2009/0039077 | A1 | 2/2009 | Fitzwater |
| 2009/0090708 | A1 | 4/2009 | Requena et al. |
| 2009/0200364 | A1 | 8/2009 | Oliveira |
| 2010/0051675 | A1 | 3/2010 | Sweet |
| 2010/0055260 | A1 | 3/2010 | Sweet |
| 2010/0102110 | A1 | 4/2010 | Learn |
| 2010/0243510 | A1 | 9/2010 | Cross |

FOREIGN PATENT DOCUMENTS

| | | |
|---|---|---|
| DE | 296 13 331 | 10/1996 |
| DE | 203 00 817 | 4/2003 |
| EP | 0 270 838 | 6/1988 |
| EP | 1 452 458 | 9/2004 |
| EP | 1 481 922 | 12/2004 |
| FR | 2 516 481 | 5/1983 |
| FR | 2 665 882 | 2/1992 |
| FR | 2 687 384 | 8/1993 |
| FR | 2 867 346 | 9/2005 |
| GB | 1049168 | 11/1966 |
| GB | 1189877 | 4/1970 |
| GB | 2 365 000 | 2/2002 |
| JP | 4-253670 | 9/1992 |
| JP | 08-207174 | 8/1996 |
| JP | 10-101056 | 4/1998 |
| JP | 03095906 | 6/2003 |
| JP | 2004-059022 | 2/2004 |
| JP | 2004 224402 | 8/2004 |
| JP | 0 3106317 | 10/2004 |
| JP | 2005-170517 | 6/2005 |
| JP | 2007-168832 | 7/2007 |
| JP | 2012-245989 | 12/2012 |
| KR | 20-0253232 | 11/2001 |
| KR | 10-2005-0090313 | 9/2005 |
| WO | WO 91/05448 | 4/1991 |
| WO | WO 94/05563 | 3/1994 |
| WO | WO 96/06021 | 2/1996 |
| WO | WO 02/40374 | 5/2002 |
| WO | WO 03/066435 | 8/2003 |
| WO | WO 2005/077783 | 8/2005 |
| WO | WO 2005/085091 | 9/2005 |
| WO | WO 2006/052326 | 5/2006 |
| WO | WO 2006/076501 | 7/2006 |
| WO | WO 2007/067705 | 7/2007 |
| WO | WO 2007/127235 | 11/2007 |
| WO | WO 2007/133659 | 11/2007 |
| WO | WO 2007/136839 | 11/2007 |
| WO | WO 2008/137525 | 11/2008 |
| WO | WO 2008/137528 | 11/2008 |
| WO | WO 2009/023286 | 11/2009 |

OTHER PUBLICATIONS

International Search Report and Written Opinion for PCT/US2019/044611 dated Nov. 20, 2019.

* cited by examiner

CONTAINER WITH AT LEAST ONE COMPARTMENT

CROSS-REFERENCE TO RELATED APPLICATION

This application claims the benefit of U.S. Provisional Patent Application No. 62/714,976, which was filed on Aug. 6, 2018.

INCORPORATION BY REFERENCE

The disclosure of U.S. Provisional Patent Application No. 62/714,976, which was filed on Aug. 6, 2018, is hereby incorporated by reference for all purposes as if presented herein in its entirety.

BACKGROUND OF THE DISCLOSURE

The present disclosure generally relates to containers for holding at least one article. In one embodiment, the present disclosure relates to a container that includes at least one compartment for holding an accessory for the at least one article.

SUMMARY OF THE DISCLOSURE

According to one aspect of the disclosure, a container for holding one or more articles comprises a plurality of panels extending at least partially around an interior of the container. The plurality of panels comprises a front panel, a back panel, at least one side panel, a bottom panel, and a divider panel separably connected to a panel of the plurality of panels. The divider panel is pivotable relative to the panel of the plurality of panels to define a compartment in the interior of the container.

According to another aspect of the disclosure, a blank for forming a container for holding one or more articles comprises a plurality of panels for extending at least partially around an interior of the container formed from the blank. The plurality of panels comprises a front panel, a back panel, at least one side panel, a bottom panel, and a divider panel separably connected to a panel of the plurality of panels. The divider panel is for being pivotable relative to the panel of the plurality of panels to define a compartment in the interior of the container formed from the blank.

According to another aspect of the disclosure, a method of forming a container for holding one or more articles comprises obtaining a blank comprising a plurality of panels comprising a front panel, a back panel, at least one side panel, a bottom panel, and a divider panel separably connected to a panel of the plurality of panels. The method further comprises folding the plurality of panels at least partially around an interior of the container and positioning the divider panel such that the divider panel is pivotable relative to the panel of the plurality of panels to define a compartment in the interior of the container.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Containers according to the present disclosure can accommodate containers of numerous different shapes. In this specification, the terms "lower," "bottom," "upper," "top," "front," and "back" indicate orientations determined in relation to fully erected containers. As described herein, containers may be formed by multiple overlapping panels, portions, and/or end flaps. Such panels, portions, and/or end flaps may be designated in relative terms to one another, e.g., "first", "second", "third", etc., in sequential or non-sequential reference, without departing from the disclosure.

Figure 1:
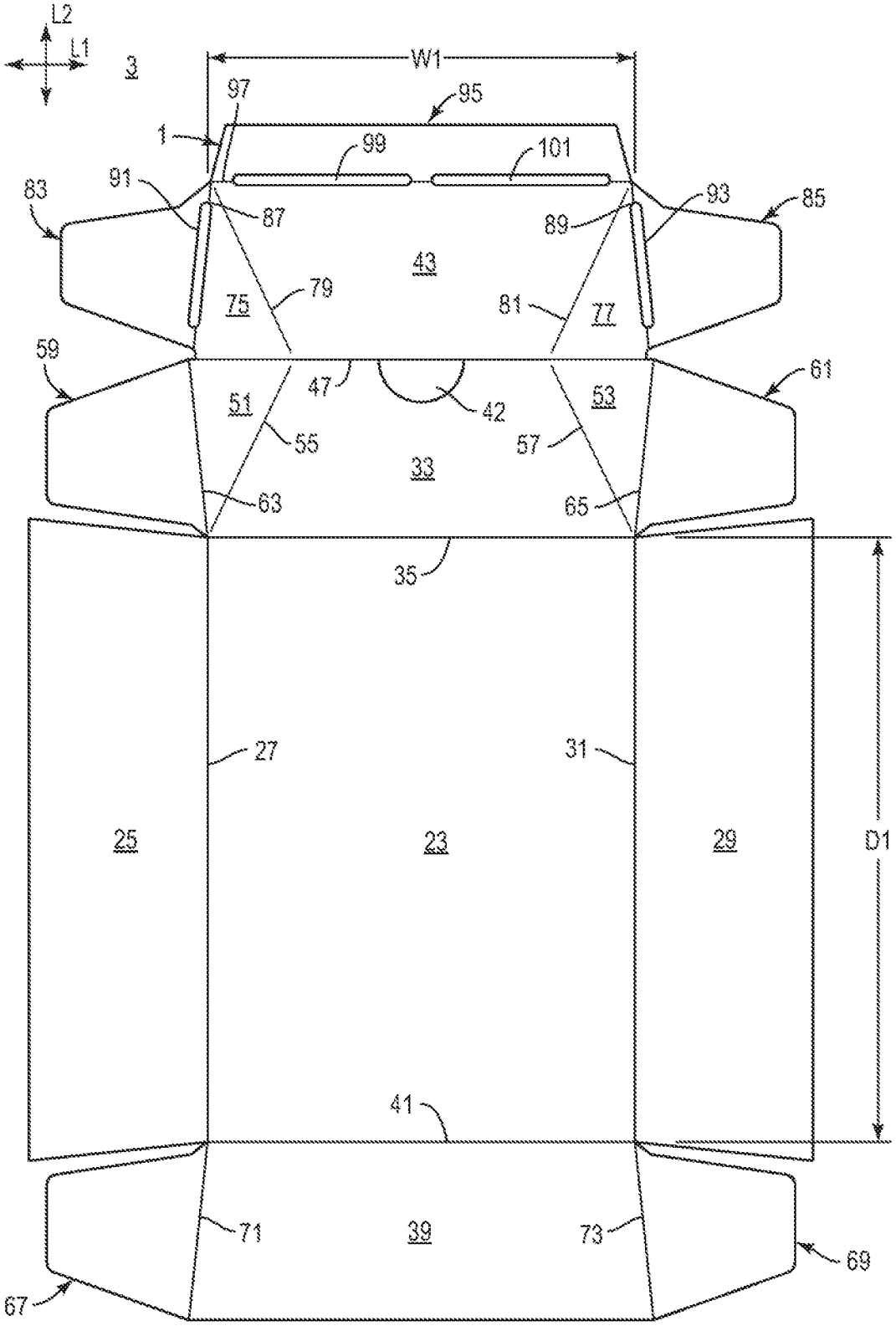
FIG. 1 is a plan view of an exterior surface of a blank for forming a container according to a first exemplary embodiment of the disclosure.

According to a first exemplary embodiment of the disclosure, FIG. 1 illustrates an exterior surface 1 of a blank 3 for forming a container 5 (FIG. 3) having a generally open top 7 such that the container 5 can be generally referred to as a tray. It will be understood that the container 5 can have a different configuration, for example, a bowl, dish, plate, box, or carton, to name a few.

The container 5 can be useful for holding one or more articles such as food products, e.g., frozen or non-frozen food products that can be provided in discrete portions, for example, chicken nuggets, French fries, onion rings, mozzarella sticks, chips, popcorn, other finger foods, etc. In embodiments, other types of articles that can include food products and/or non-food products can be placed in the container 5 for service to a customer. Such products can be contained in additional packaging and then placed in the container 5. As described further herein, the container 5 includes a compartment 11 within which an accessory for one or more food products can be disposed, for example, a sauce or dressing (e.g., ketchup, mustard, barbeque sauce, dip, etc.) and/or another condiment. The container 5 could be otherwise shaped and arranged and could be used to hold other products and/or articles in similar or different environments without departing from the disclosure.

As shown in FIG. 1, the blank 3 has a lateral axis L1 and a longitudinal axis L2. As illustrated, the blank 3 includes a central or bottom panel 23, a first side panel 25 foldably connected to the bottom panel 23 at a longitudinal fold line 27, a second side panel 29 foldably connected to the bottom panel 23 at a longitudinal fold line 31, a front panel 33 (broadly, "a panel of the plurality of panels") foldably connected to the bottom panel 23 at a lateral fold line 35, and a back panel 39 foldably connected to the bottom panel 23 at a lateral fold line 41. The front panel 33, as shown, includes a cutout 42 proximate a distal edge thereof. As described further herein, a compartment panel or divider panel 43 is attached to the front panel 33 at a lateral tear line 47 that is interrupted by the cutout 42 and such that the divider panel 43 is separably connected to the front panel 33. In one embodiment, the tear line 47 provides an at least partial foldable connection of the divider panel 43 to the front panel 33, but the divider panel 43 and the front panel 33 are separable at one or more portions thereof.

A first front corner panel 51 and a second front corner panel 53, as shown, are foldably connected to the front panel 33 at respective oblique fold lines 55, 57. A first front end flap 59 and a second front end flap 61 are foldably connected to the respective corner panels 51, 53 at respective oblique fold lines 63, 65. As also shown, a first back end flap 67 and a second back end flap 69 are foldably connected to the back panel 39 at respective oblique fold lines 71, 73.

Still referring to FIG. 1, a first divider corner panel 75 and a second divider corner panel 77 are each foldably connected to the divider panel 43 at respective oblique fold lines 79, 81. A first divider end flap 83 and a second divider end flap 85, as shown, are foldably connected to the respective corner panels 75, 77 at respective oblique fold lines 87, 89 that are interrupted by respective relief slots or openings or slots 91, 93. A distal end flap 95, as shown, is foldably connected to the divider panel 43 at a lateral fold line 97 that is interrupted by relief openings or slots 99, 101.

Figure 2:
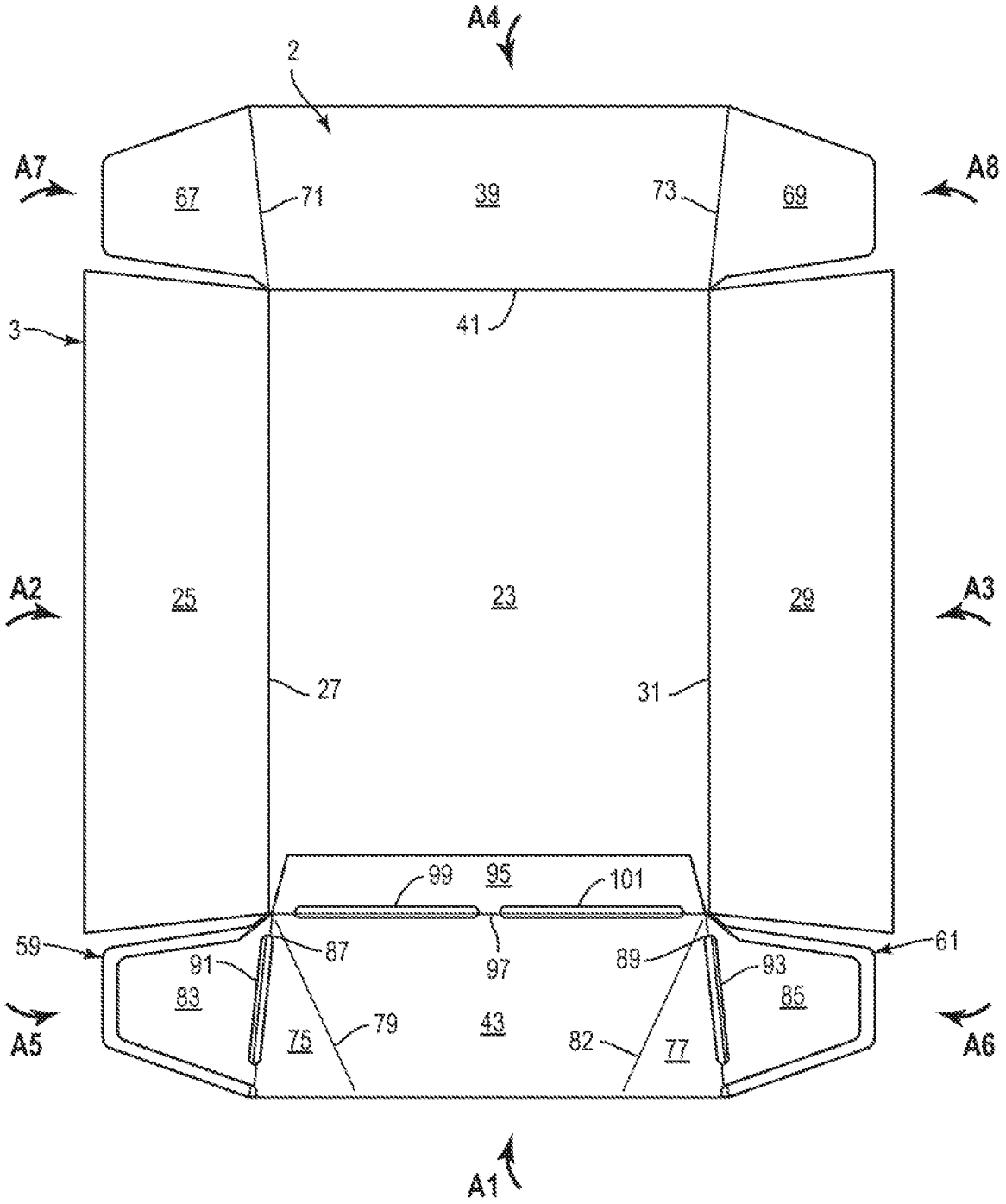
FIG. 2 is a plan view of a partially folded configuration of the blank of FIG. 1.
Figure 3:
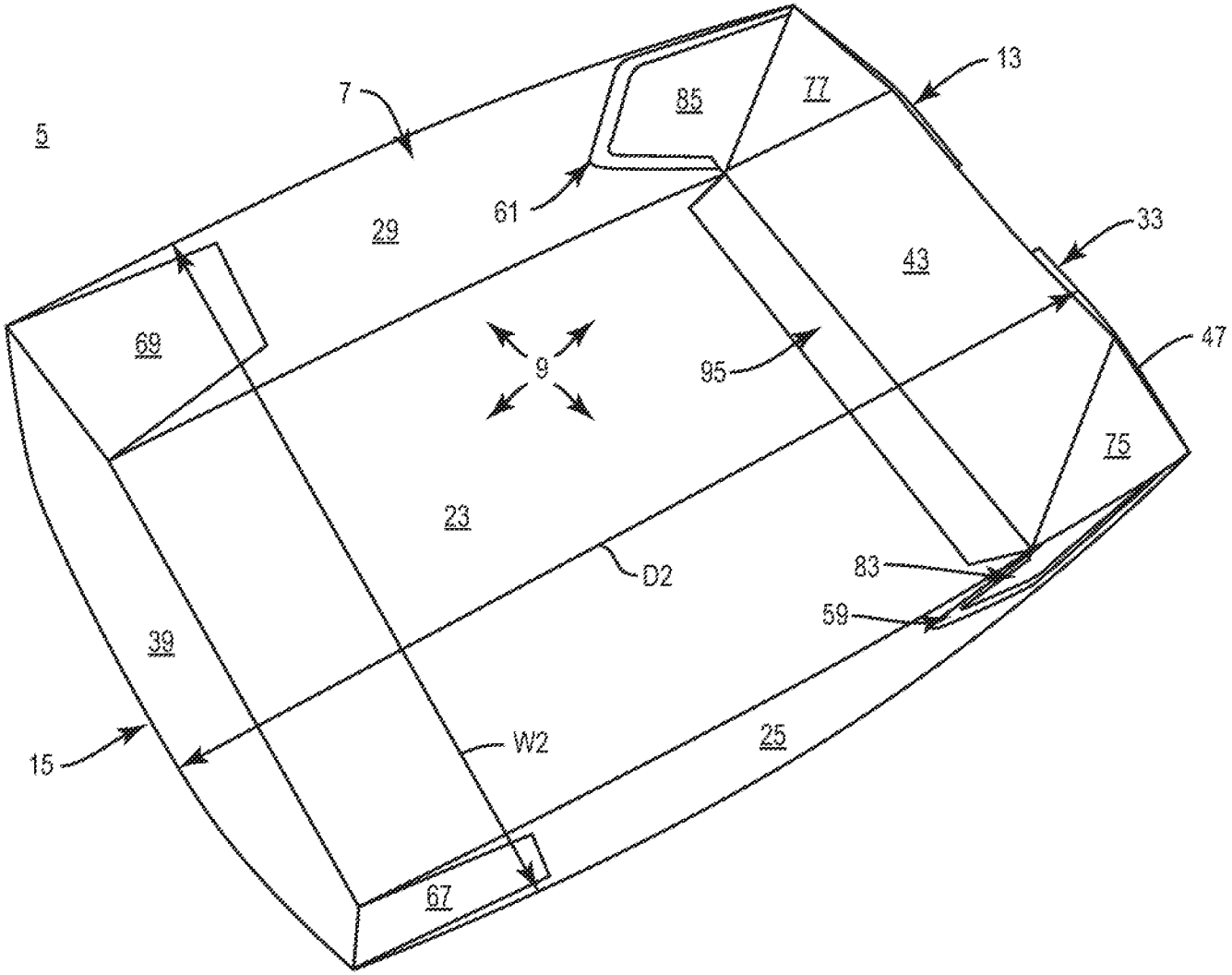
FIG. 3 is a perspective view of a container formed from the blank of FIG. 1 and in a first configuration.

Referring additionally to FIGS. 2 and 3, formation of the container 5 from the blank 3 is illustrated according to one exemplary embodiment of the disclosure. As shown, the blank 3 can be placed with the exterior 1 facing down and an interior surface 2 of the blank 3 is positioned facing upward. The divider panel 43 can be folded at the tear line 47 in the direction of the arrow A1 such that the divider panel 43 is in at least partial face-to-face contact with the front panel 33, such that the respective corner end flaps 83, 85 are carried with the divider panel 43 to be positioned in at least partial face-to-face contact with the respective front end flaps 59, 61, and such that the distal end flap 95 is carried with the divider panel 43 to be positioned in at least partial face-to-face contact with the bottom panel 23.

Thereafter, the divider panel 43, the side panels 25, 29, and the back panel 39 can be folded at the respective fold lines 97, 27, 31, 41 in the direction of the respective arrows A1, A2, A3, A4 to be positioned generally upright relative to the bottom panel 23. Such folding of the divider panel 43 also causes the front panel 33 to fold upwardly at the fold line 41 in the direction of the arrow A1.

Simultaneously or thereafter, the overlapping corner end flap 83 and the front end flap 59, and the overlapping the corner end flap 85 and the front end flap 61 are folded at the respective fold lines 87, 63 and 89, 65 in the direction of the respective arrows A5, A6 to extend generally obliquely away from the divider panel 43/front panel 33 and into at least partial overlapping relation with the respective side panels 25, 29. In such an arrangement, the front end flaps 83, 85 are positioned in at least partial face-to-face contact with the respective side panels 25, 29. Similarly, the back end flaps 67, 69 are folded at the respective fold lines 71, 73 in the direction of the respective arrows A7, A8 to be positioned extending obliquely away from the back panel 39 and in at least partial face-to-face contact with the respective side panels 25, 29. The aforementioned arrangement can be maintained with an adhesive, for example, glue.

FIG. 3 illustrates a first or nesting configuration of the container 5 formed by the aforementioned folding, in which the divider panel 43 is in at least partial face-to-face contact with the front panel 33 at a first end 13 of the container 5 that is opposite a second end 15 of the container 5. In such a configuration, the panels of the container 5 are arranged such that a bottom portion of another container can be received in the interior 9 of the container 5.

For example, the first configuration of the container 5 illustrated in FIG. 3 has a generally tapered configuration, e.g., such that the panels 25, 29, 33, 43, 39 are generally obliquely disposed relative to the bottom panel 23. As shown, the bottom panel 23 has a width W1 (FIG. 1) along the lateral axis L1, the bottom panel 23 has a length D1 (FIG. 1) along the longitudinal axis L2, a width W2 of the open top 7 of the erected container 5 is defined between the top edges of the side panels 25, 29 and a length D2 of the open top 7 of the erected container 5 is defined between the top edges of the front panel 33 and the back panel 39 such that D2>D1 and W2>W1. In one embodiment, D1 can be about 170 mm and W1 can be about 120 mm. In this regard, the container 5 is provided with a tapered configuration such that multiple containers 5 can be nested with one another, e.g., so that each container 5 can at least partially receive a container 5 above and/or can be at least partially received in a container 5 below.

Figure 4:
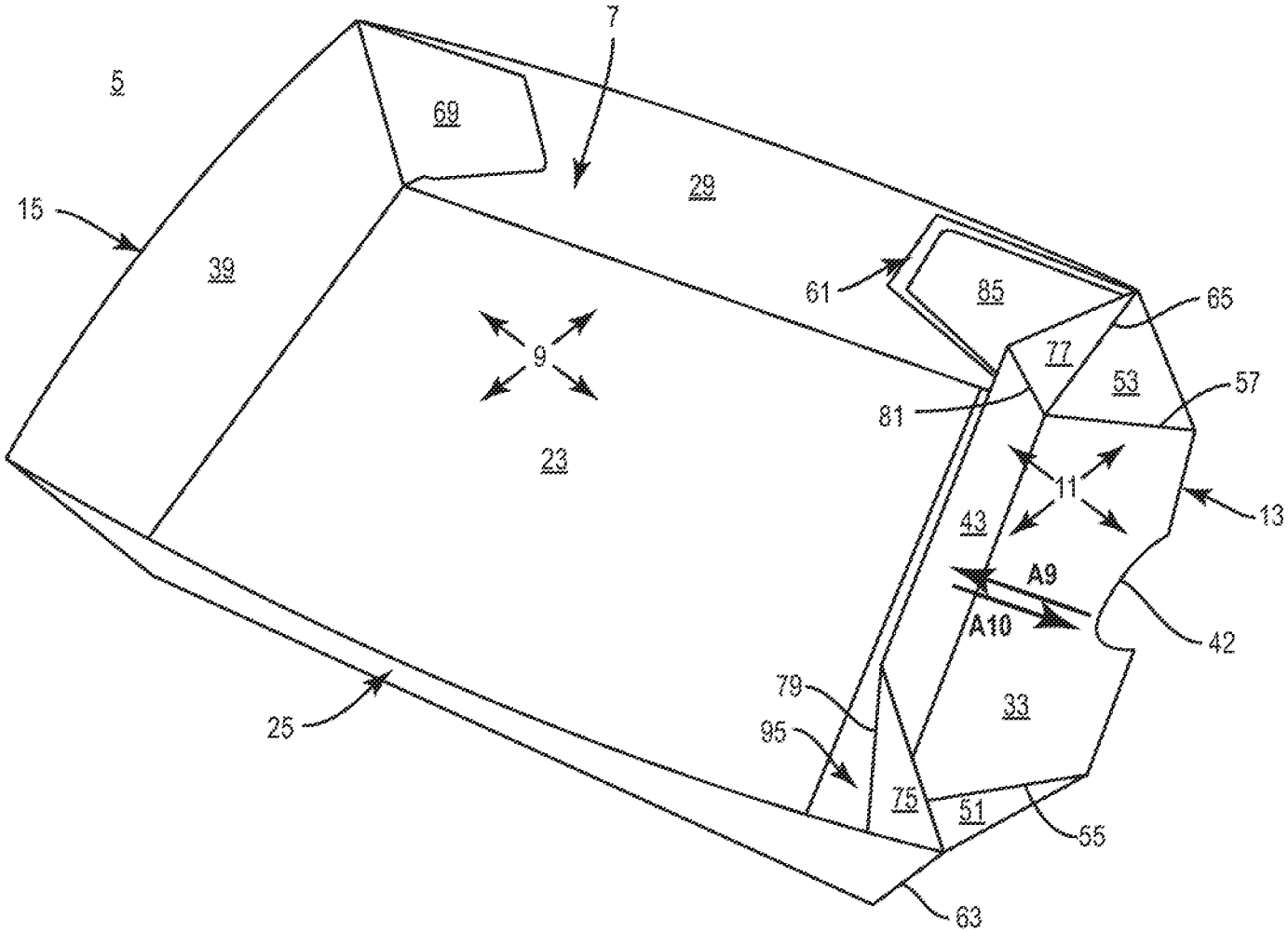
FIG. 4 is a perspective view of the container of FIG. 2 in a second configuration.

Turning to FIG. 4, in a second or serving configuration of the container 5, the divider panel 43 can be separated from the front panel 33 by tearing at the tear line 47 such that a top edge of one or both of the front panel 33 and the divider panel 43 are at least partially free edges of the container 5. Thereafter, the divider panel 43 can be urged away from the front panel 33, for example, via access by a user or a tool adjacent the cutout 42, to at least partially fold the divider panel 43 at the fold line 97 in the direction of the arrow A9 to cause the divider panel 43 to at least partially pivot rearwardly of the front panel 33 to a second position. Such movement of the divider panel 43 is at least partially facilitated by the attachment of the distal end flap 95 to the bottom panel 23 such that the divider panel 43 is pivotable at the bottom panel 23 via the fold line 97. Movement of the divider panel 43 to the second position can cause the corner panels 75, 77 to at least partially fold relative to the divider panel 43 at the respective fold lines 79, 81 to be positioned in an oblique arrangement relative to each of the divider panel 43 and the front panel 33.

Such serving arrangement of the container 5 can be accomplished, in one embodiment, by squeezing or pinching the sides of the container 5 at or near the fold lines 63, 65, 87, 89 such that the front panel 33 is also urged to fold at least partially at the fold line 35 in the direction of the arrow A10 to pivot forwardly away from the front divider panel 43. Such movement of the front panel 33 can cause the back corner panels 51, 53 to at least partially fold relative to the front panel 33 at the respective fold lines 55, 57 to be positioned in an oblique arrangement relative to each of the divider panel 43 and the front panel 33. In addition, the aforementioned manipulation of the container 5 can cause the side panels 25, 29 to at least partially tilt toward one another, e.g., such that the container 5 at least partially tapers toward the front end 13.

The aforementioned spaced apart arrangement of the front panel 33 and the divider panel 43 defines a compartment 11 therebetween and which is partitioned from the remainder of the interior 9 of the container 5 by the divider panel 43 and the corner panels 75, 77. In this regard, a second configuration of the container 5 is illustrated in FIG. 4 in which the compartment 11 is defined between the divider panel 43, the front panel 33, and the corner panels 51, 53, 75, 77.

The compartment 11 provides a convenient location, for example, to deposit, store, and/or access one or more sauces or other condiments in the interior 9 of the container 5. In addition, the divider panel 43 and the corner panels 75, 77 provide a barrier between the compartment 43 and the remainder of the interior 9, for example, so that sauces or other condiments stored in the compartment 11 do not intermix with food products stored in the remainder of the interior 9 of the container 5. In this regard, in one embodiment, a user can retrieve one or more food products from the interior 9 of the container 5 and at least partially insert the one or more food products into the compartment 43, for example, to dip the food product and/or scoop sauces or other condiments stored in the compartment 11. While the compartment 11 has been described as a portion of the interior 9 of the container 5, it will be understood that the interior 9 of the container 5, excluding the compartment 11, can be a first compartment of the container 5, and the compartment 11 can be a second compartment of the container 5.

In this regard, the container 5 can be transitioned between the first configuration (e.g., having the divider panel 43 in at least partial facing relation with the front panel 33, and the second configuration (e.g., having the compartment 11 defined between the spaced apart front panel 33 and divider panel 43), for example, by selectively pivoting the divider panel 43 at the fold line 97 and/or by selectively pivoting the front panel 33 at the fold line 35. It will be understood that the compartment 11 can be formed via movement of either or both of the divider panel 43 and the front panel 33 as described herein.

Figure 5:
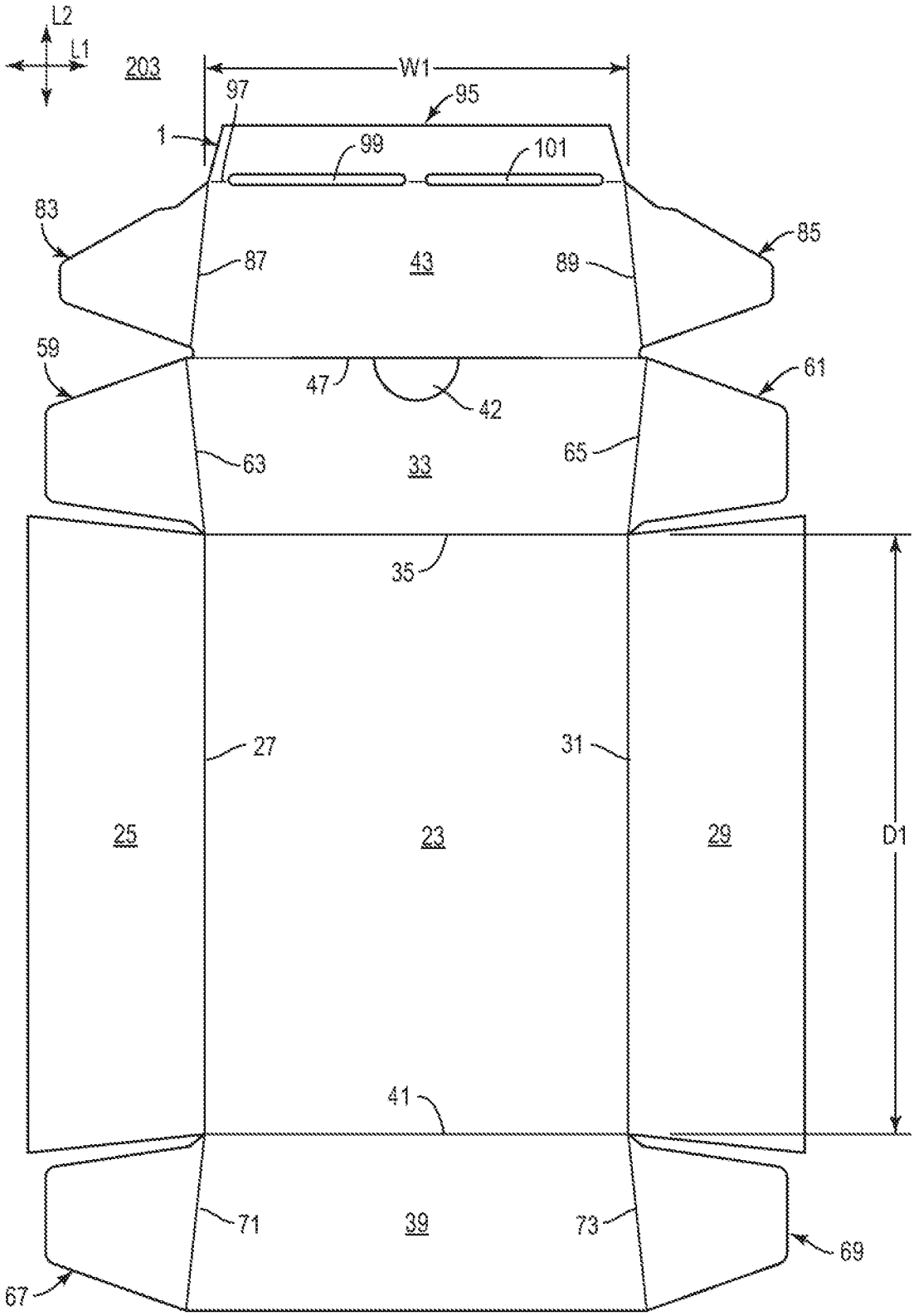
FIG. 5 is a plan view of an exterior surface of a blank for forming a container according to a second exemplary embodiment of the disclosure.

Turning to FIG. 5, a blank 203 for forming a container 205 (FIG. 6) according to a second exemplary embodiment of the disclosure is illustrated. The blank 203/container 205 includes one or more portions that are substantially similar to those of the blank 3/container 5 of the first exemplary embodiment of the disclosure, and like or similar features are designated with like or similar reference numbers. The blank 203, as shown, can be devoid of the corner panels 51, 53, 75, 77 such that the respective end flaps 59, 61 and 83, 85 are foldably connected to the respective front panel 33 and divider panel 43 at the respective fold lines 63, 65 and 87, 89 with no or minimal intermediate structure.

Figure 6:
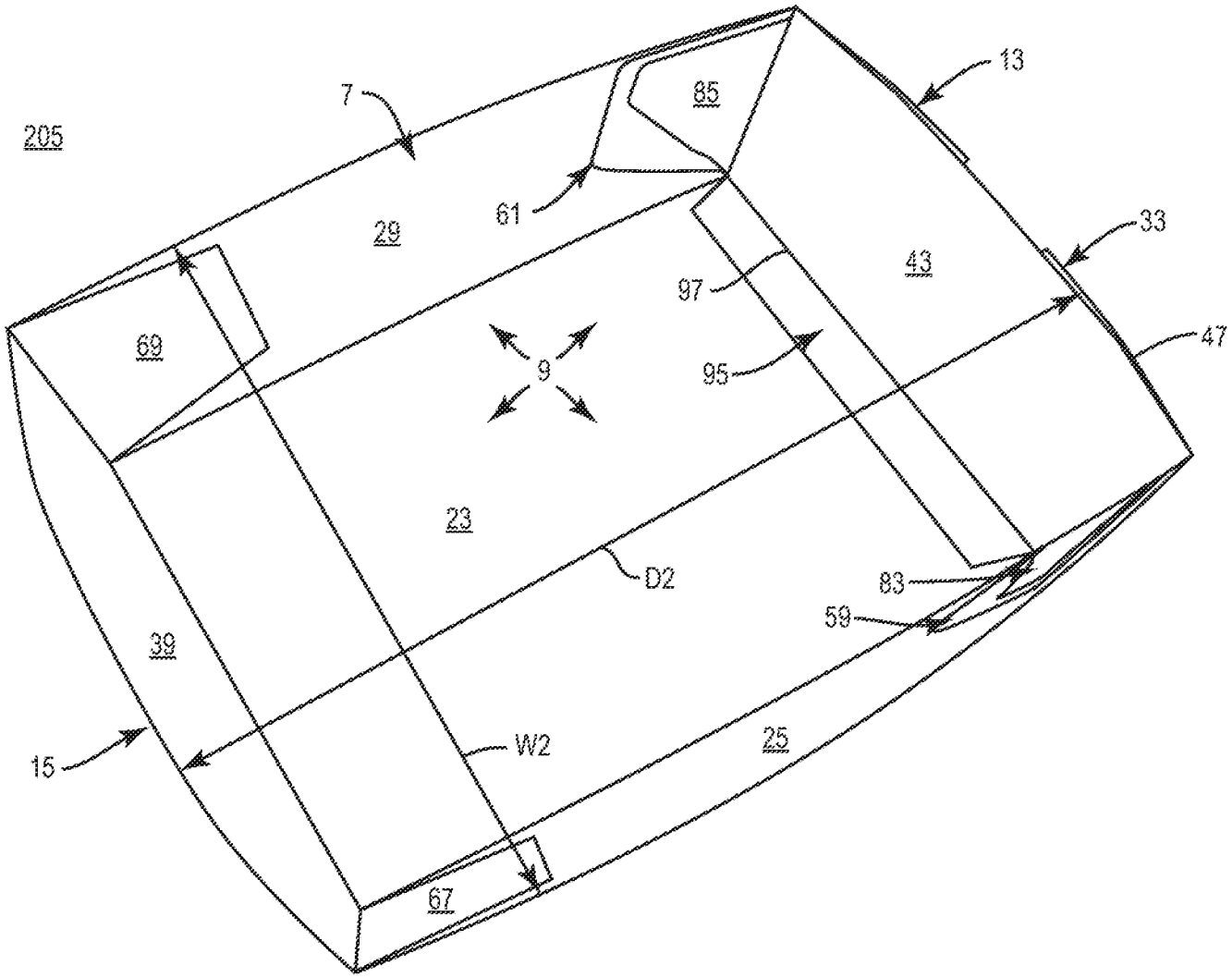
FIG. 6 is a perspective view of a container formed from the blank of FIG. 5 in a first configuration according to the second exemplary embodiment of the disclosure.

The blank 203 can be formed into a container having features that are substantially similar to the container 5 (FIG. 3) of the first exemplary embodiment, but devoid of the respective corner panels 51, 53, 75, 77 as described above. FIG. 6 illustrates a first or nesting arrangement of the container 205 formed from the blank 203, in which the divider panel 43 can be pivoted forwardly at the fold line 97 to a first position in which the divider panel 43 is in at least partial face-to-face contact with the front panel 33.

Figure 7:
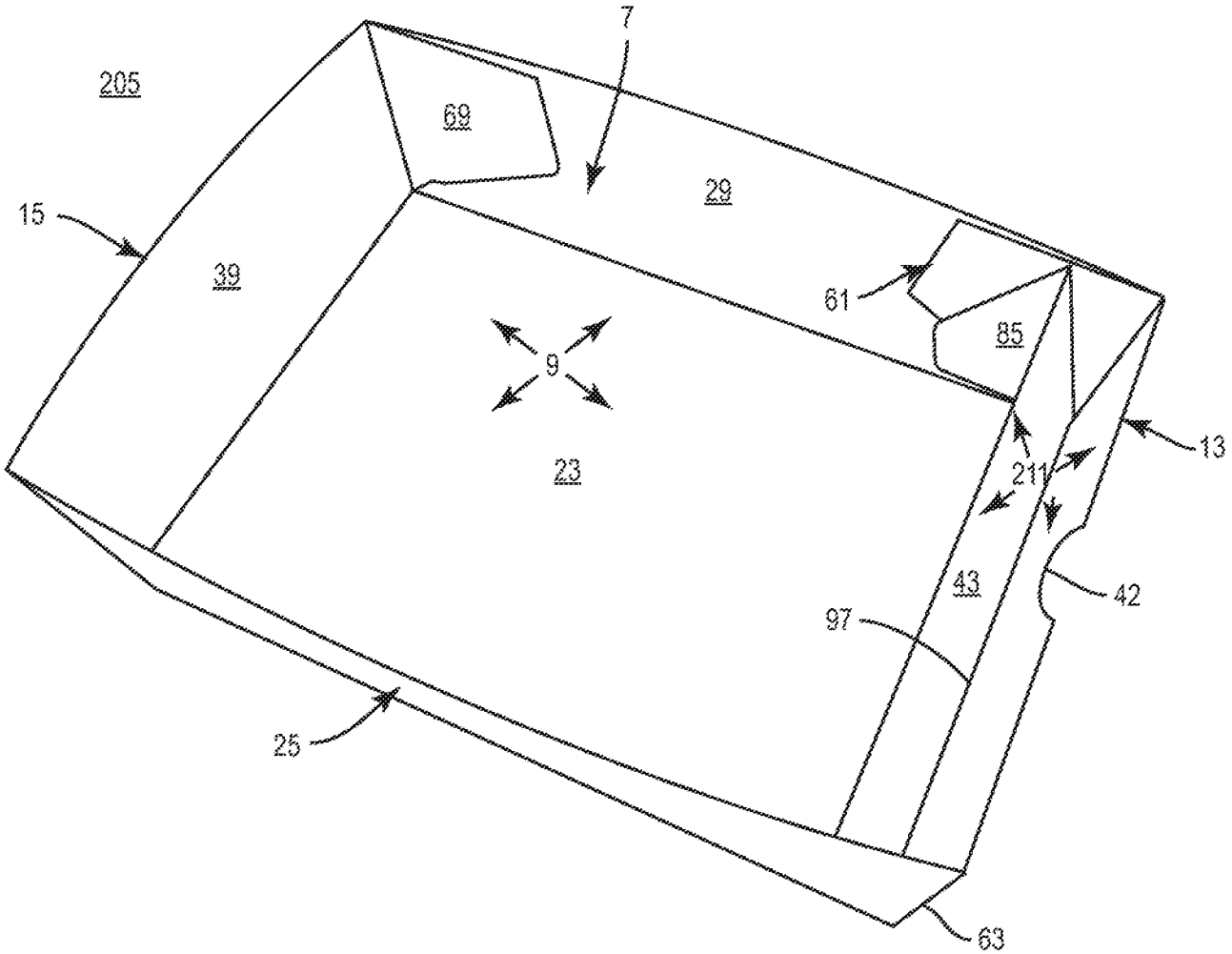
FIG. 7 is a perspective view of the container of FIG. 6 in a second configuration.

In a second or serving configuration of the container 205, as illustrated in FIG. 7, the divider panel 43 can be separated from the front panel 33 at the line of weakening 47 as described above, and the divider panel 43 can be pivoted rearwardly at the fold line 97 to be spaced apart from the front panel 33 and form a compartment 211 therebetween. The divider end flaps 83, 85 are free to slide along portions of the respective front end flaps 59, 61 so as to be carried rearwardly with the divider panel 43. In this regard, the front end flaps 59, 61 can act as stops or limiters that contact the bottom panel 23 to inhibit rearward movement of the divider panel 43 beyond a desired position. As the container 205 is devoid of corner panels, the divider flap 43 remains in a generally flat or planar configuration in the second configuration. The blank 203/container 205 can have a different arrangement without departing from the disclosure.

Figure 8:
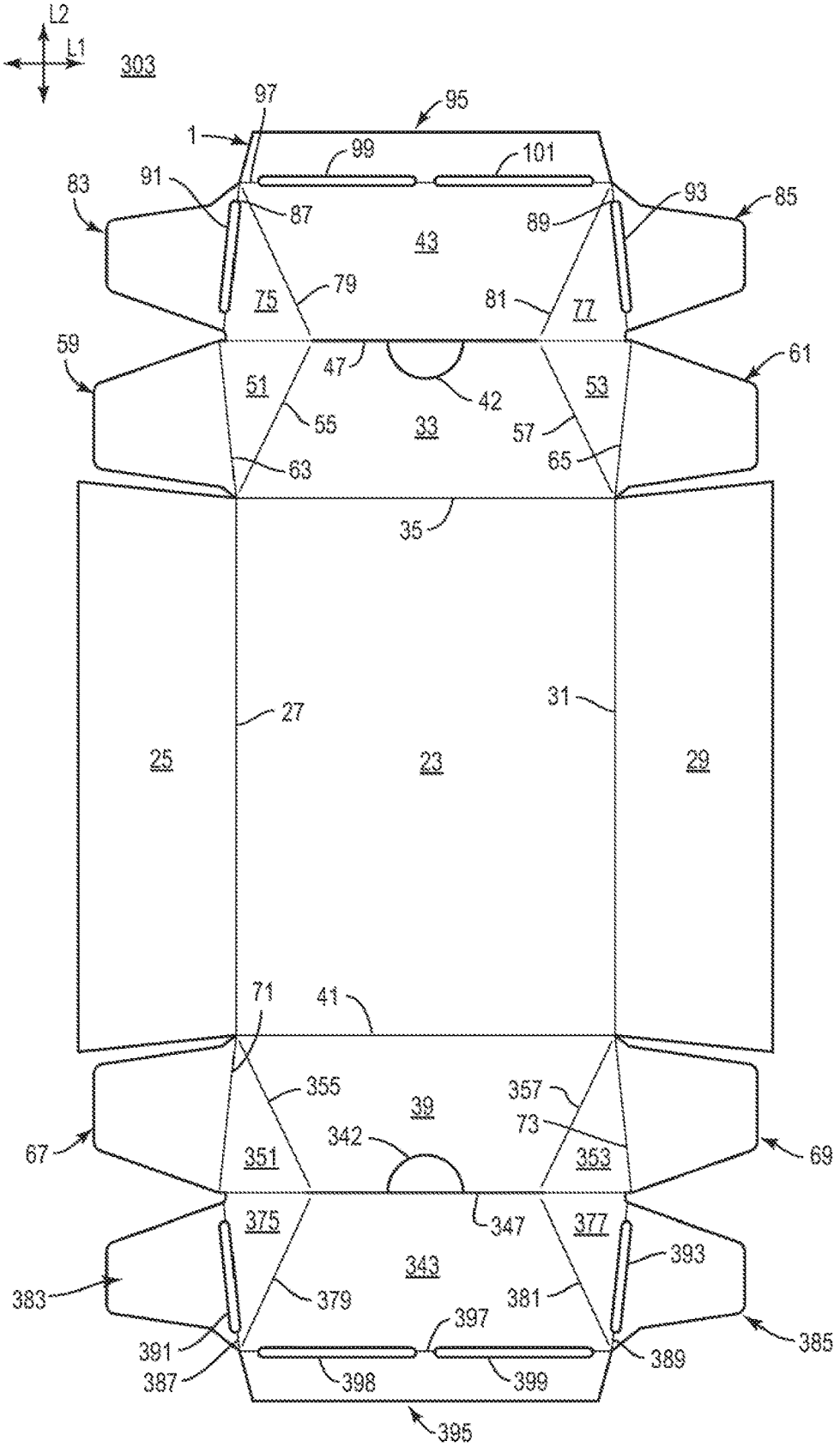
FIG. 8 is a plan view of an exterior surface of a blank for forming a container according to a third exemplary embodiment of the disclosure.

Turning to FIG. 8, a blank for forming a container 305 according to a third exemplary embodiment of the disclosure is generally designated 303. The blank 303 and container 305 can have one or more features that are substantially similar to those of the blank 103/container 105 and the blank 203, and like or similar features are designated with like or similar reference numerals.

As shown, the blank 303 includes additional features for aiming a second compartment 311 on a second end 315 of the container 305 that is opposite the compartment 11 (broadly, "first compartment") at the first end 313 of the container 305. In particular, the back panel 39 of the blank 303 can be provided with substantially similar features of the front panel 33 such that back corner panels 351, 353 are foldably connected thereto at respective fold lines 355, 357. A second or back divider panel 343 can be foldably attached to the back panel 39 at a lateral tear line 347 that is interrupted by a cutout 342. Respective first and second back divider corner panels 375, 377 are foldably connected to the back divider panel 343 at respective oblique fold lines 379, 381, divider end flaps 383, 385 are foldably connected to the back divider panel 343 at respective oblique fold lines 387, 389 that are interrupted by respective slots 391, 393, and a distal end flap 395 is foldably connected to the back divider panel 343 at a lateral fold line 397 that is interrupted by slots 398, 399.

The blank 303 can be formed into the container 305 in a substantially similar manner as described above with respect to the container 5, and the features for forming the second compartment 311 can be arranged in a substantially similar manner as those for forming the compartment 11, e.g., with the back end flaps 67, 69 positioned in at least partial face-to-face contact with the respective side panels 25, 29 and the back corner end flaps 383, 385 positioned in at least partial face-to-face contact with the respective back end flaps 67, 69, and with the distal end flap 395 positioned in at least partial face-to-face contact with the bottom panel 23.

Figure 9:
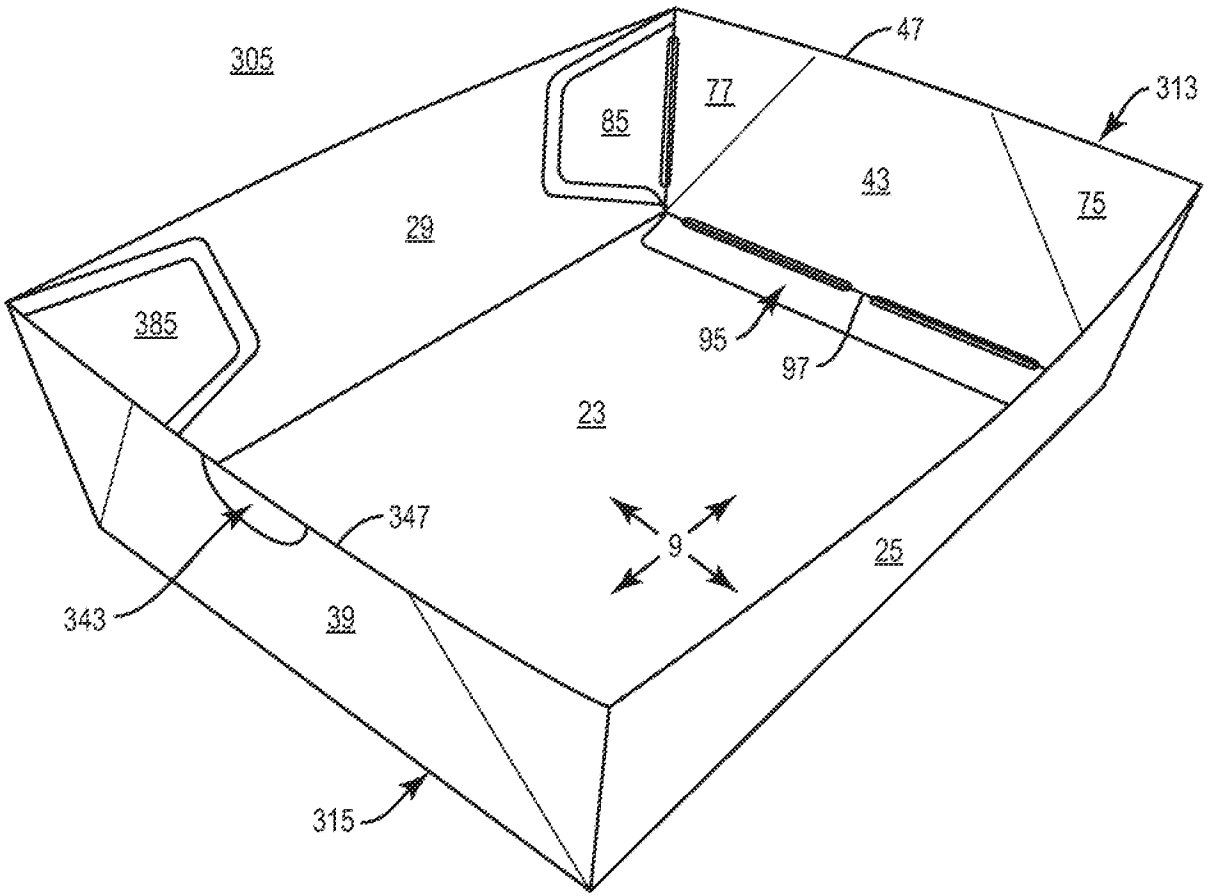
FIG. 9 is a perspective view of a container formed from the blank of FIG. 8 in a first configuration according to the third exemplary embodiment of the disclosure.

A first or nesting arrangement of such container 305 formed from the blank 303 is illustrated in FIG. 9, in which the divider panel 43 (broadly, "first divider panel" or "front divider panel") is pivoted forwardly at the fold line 97 to a first position in which the front divider panel 43 is in at least partial face-to-face contact with the front panel 33 and the back divider panel 343 is pivoted rearwardly at the fold line 397 to a first position in which the back divider panel 343 is in at least partial face-to-face contact with the back panel 39.

Figure 10:
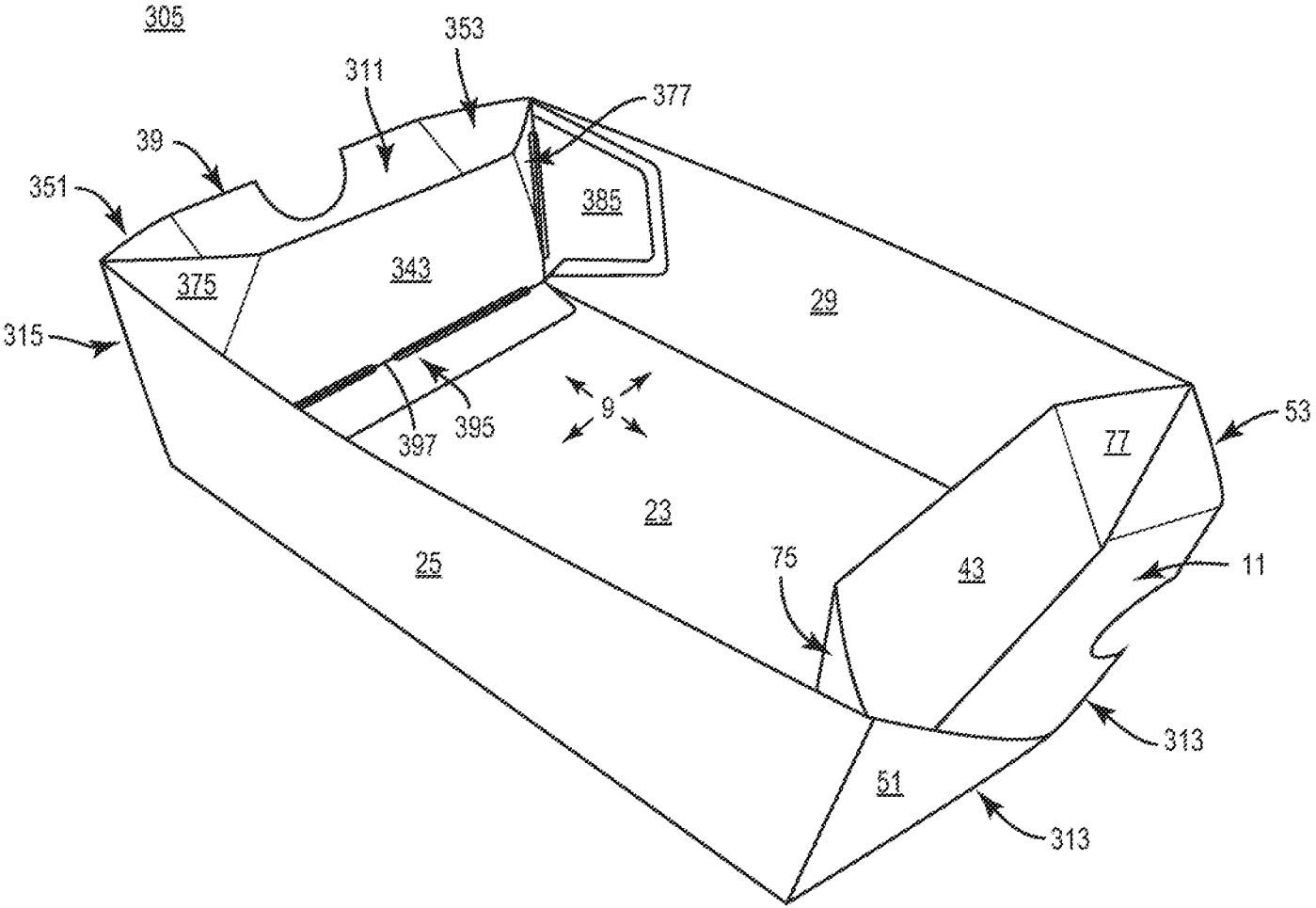
FIG. 10 is a perspective view of the container of FIG. 9 in a second configuration.

In a second or serving configuration of the container 305, as illustrated in FIG. 10, the front divider panel 43 can be separated from the front panel 33 at the line of weakening 47 as described above to form the first compartment 11, and the back divider panel 343 can be separated from the back panel 39 at the tear line 347 and at least partially folded forwardly at the respective fold line 397 to a second position to faun the second compartment 311. Such movement of the back divider panel 343 is at least partially facilitated by the attachment of the distal end flap 395 to the bottom panel 23 such that the back divider panel 343 is pivotable at the bottom panel 23 via the respective fold line 397. The front panel 33 can also be pivoted forwardly at the fold line 35 in the course of formation of the first compartment 11 and the back panel 39 can be pivoted rearwardly at the fold line 41 in the course of formation of the second compartment 311.

Movement of the divider panel 343 to the second position can cause the corner panels 375, 377 to at least partially fold relative to the back divider panel 343 at the respective fold lines 379, 381 to be positioned in an oblique arrangement relative to each of the back divider panel 343 and the back panel 39.

Such serving configuration of the container 305 can be accomplished, in one embodiment, by squeezing or pinching the sides of the container 305 at or near the fold lines 63, 65, 87, 89 as described above to form the first compartment 11, and by squeezing or pinching the sides of the container 305 at or near the fold lines 71, 73, 387, 389 to form the second compartment 311.

In this regard, the container 305 can be provided with a pair of compartments 11, 311 at respective opposite ends 313, 315 of the container 305. The presence of the additional compartment 311 can provide an additional location in the container 305 to deposit, store, and/or access one or more sauces or other condiments in the interior 9 of the container 305. In one embodiment, the compartment 311 can receive one or more condiments that are different than those in the compartment 11. In one embodiment, the interior 9 of the container 305, excluding the compartments 11, 311, can be a first compartment of the container 305, the compartment 11 can be a second compartment of the container 305, and the compartment 311 can be a third compartment of the container 305.

Figure 11:
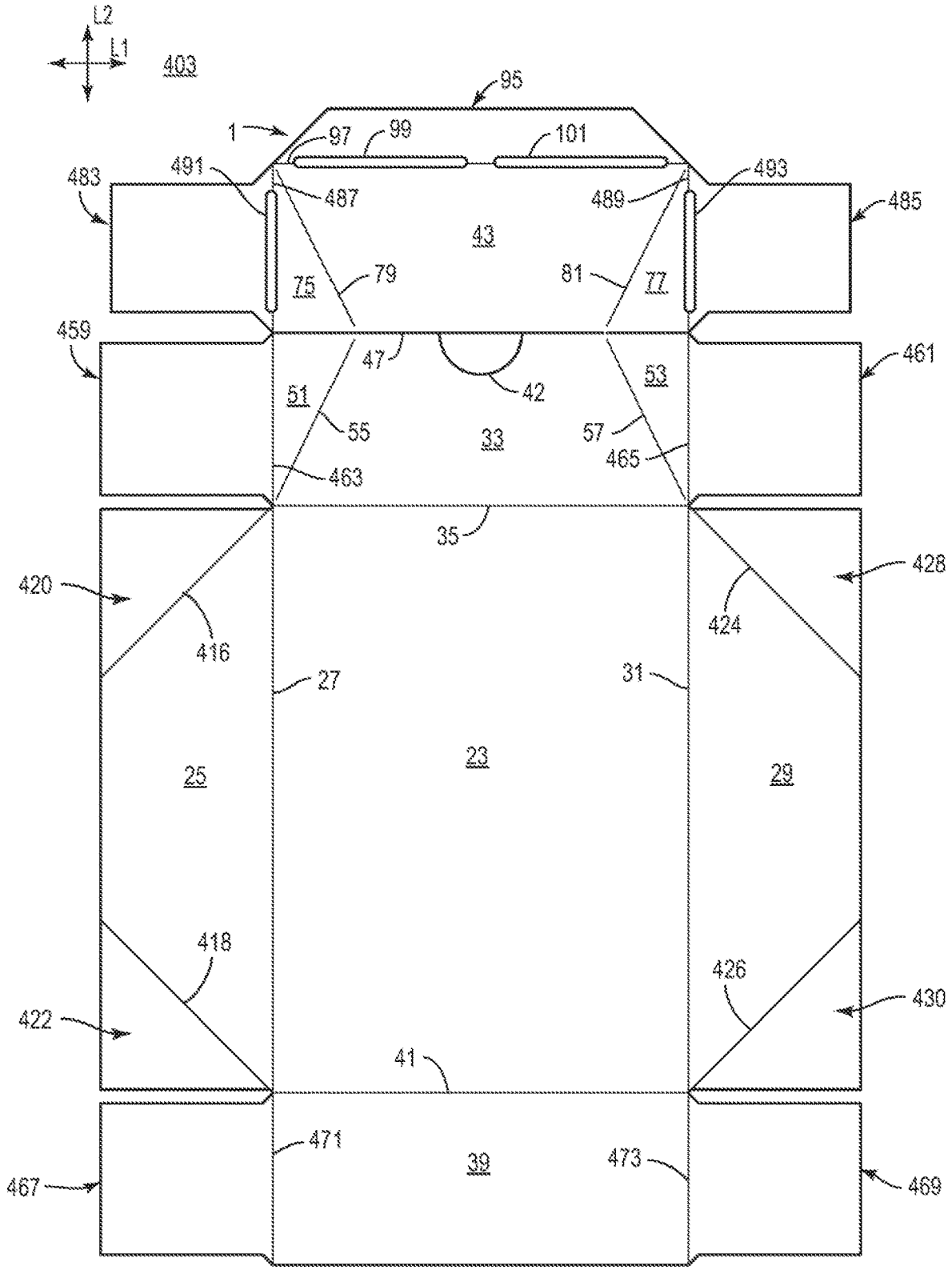
FIG. 11 is a plan view of an exterior surface of a blank for forming a container according to a fourth exemplary embodiment of the disclosure.

Turning to FIG. 11, a blank for forming a container 405 according to a fourth exemplary embodiment of the disclosure is generally designated 403. The blank 403 and container 405 can have one or more features that are substantially similar to those of the blank 3/container 5, and like or similar features are designated with like or similar reference numerals.

As shown, the blank 403 includes front end flaps 459, 461 that are foldably connected to the front panel 43 at respective longitudinal fold lines 463, 465, and back end flaps 467, 469 that are foldably connected to the back panel 39 at respective longitudinal fold lines 471, 473. Divider end flaps 483, 485 are foldably connected to the divider panel 43 at respective longitudinal fold lines 487, 489 that are interrupted by respective longitudinal slots 491, 493. Each of the end flaps 455, 457, 467, 469, 483, 485 can have a different configuration than the respective end flaps 59, 61, 67, 69 of the first exemplary embodiment. In one embodiment, one or more of the end flaps 459, 461, 467, 469, 483, 485 can have a square or rectangular configuration.

In addition, an oblique fold line 416 can extend from the intersection of the fold lines 27, 35 to a free edge of the side panel 25 and an oblique fold line 418 can extend from the intersection of the fold lines 27, 41 to a free edge of the side panel 25 to define respective end portions 420, 422 of the side panel 25. As also shown, an oblique fold line 424 can extend from the intersection of the fold lines 31, 35 to a free edge of the side panel 29 and an oblique fold line 426 can extend from the intersection of the fold lines 31, 41 to a free edge of the side panel 29 to define respective end portions 428, 430 of the side panel 29.

Figure 12:
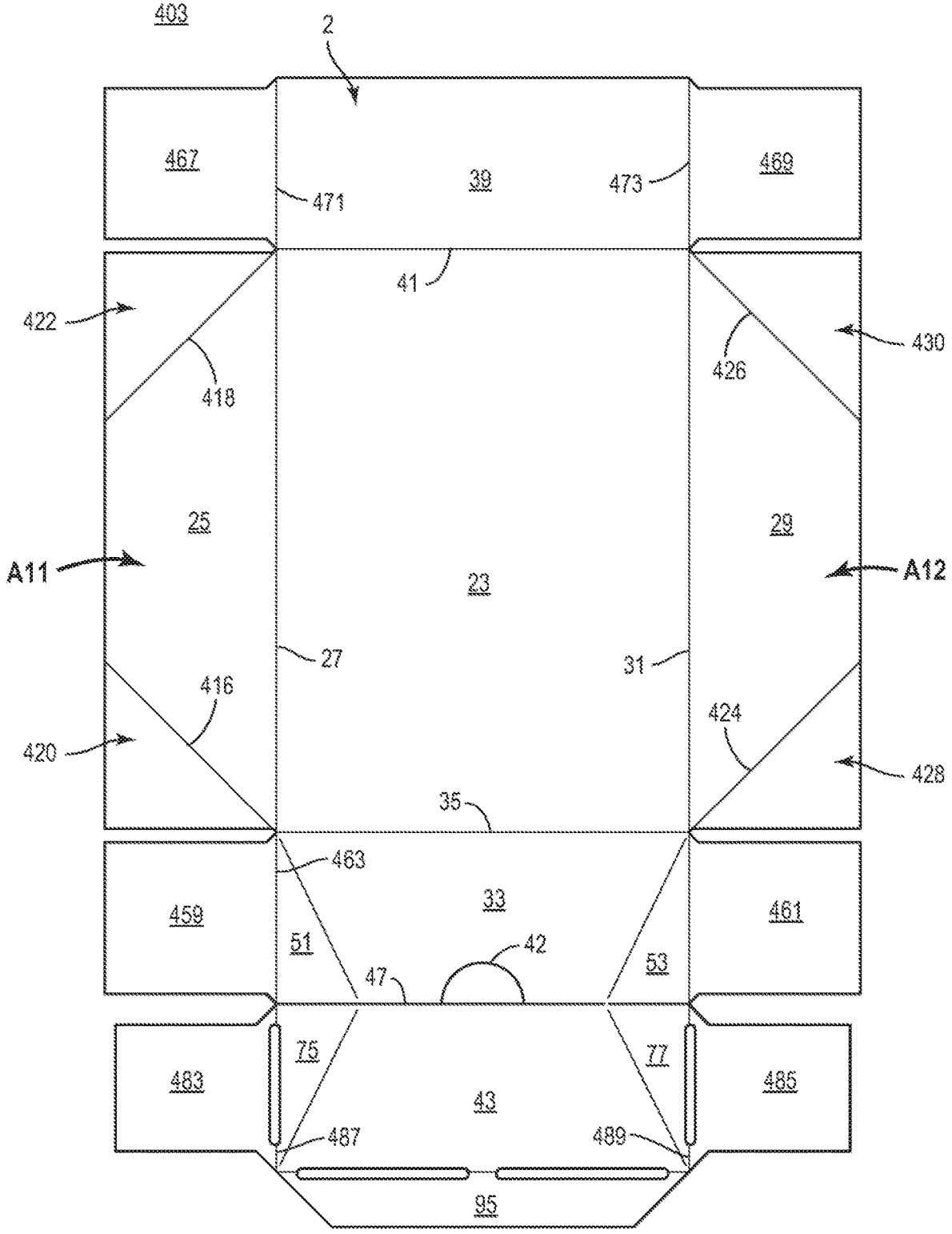
FIG. 12 is a first sequential plan view of a partial folding of the blank of FIG. 11.
Figure 13:
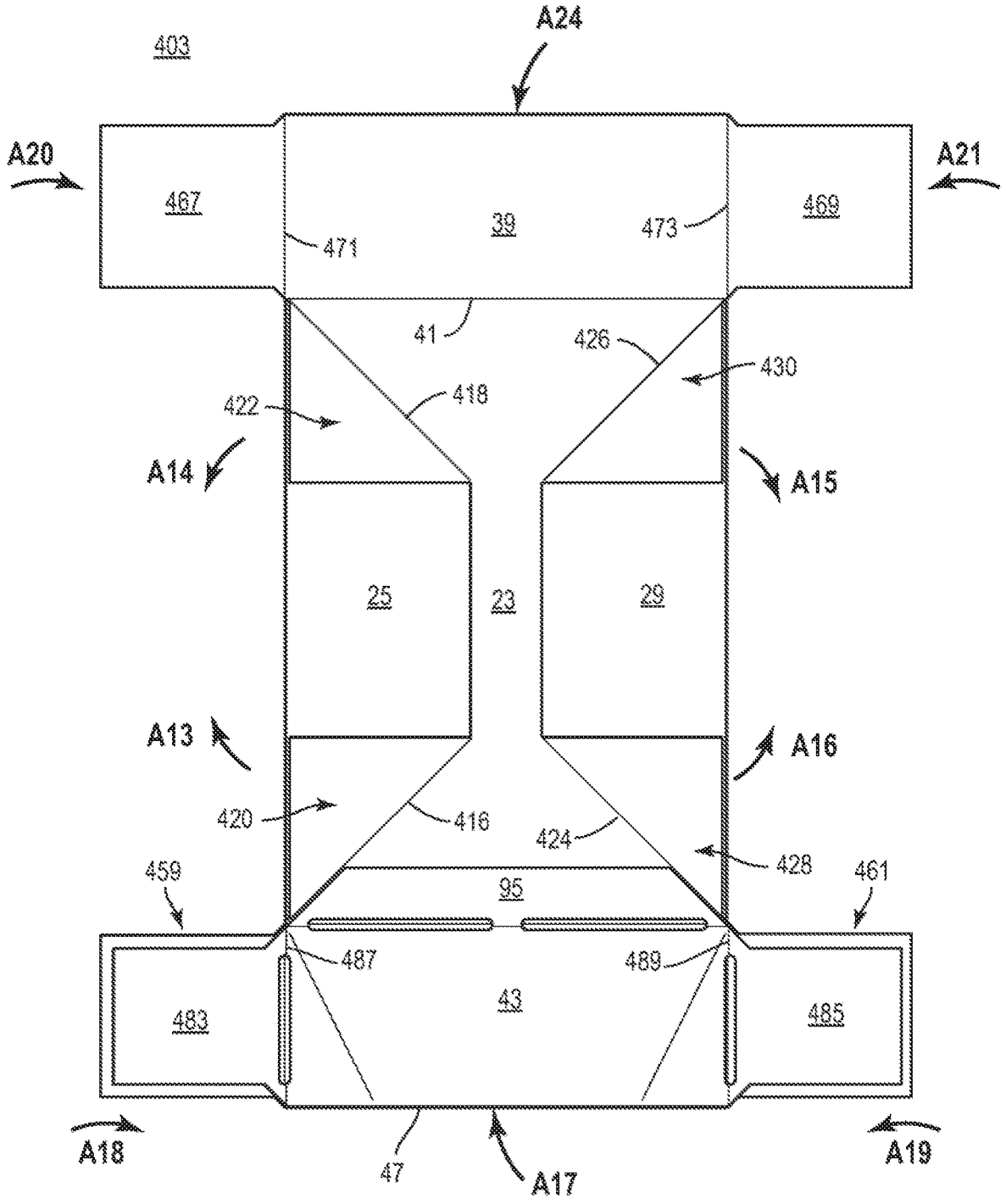
FIG. 13 is a second sequential plan view of a partial folding of the blank of FIG. 12.

Referring additionally to FIGS. 12 and 13, formation of the container 405 from the blank 403 is illustrated according to one exemplary embodiment of the disclosure. As shown, the blank 403 can be placed with the exterior surface 1 facing down and an interior surface 2 of the blank 403 is positioned facing upward. The side panels 25, 29 can be folded at the respective fold lines 27, 31 in the direction of the respective arrows A11, A12 into at least partial face-to-face contact with the bottom panel 23.

Simultaneously or thereafter, respective end portions 420, 422 and end portions 428, 430 of the respective side panels 25, 29 can be folded at the respective fold lines 416, 418 and 424, 426 in the direction of the respective arrows A13, A14 and arrows A15, A16 into at least partial face-to-face contact with exterior portions of adjacent portions of the respective side panels 25, 29.

The divider panel 43 can be folded at the tear line 47 in the direction of the arrow A17 such that the divider panel 43 is in at least partial face-to-face contact with the front panel 33, such that the respective corner end flaps 483, 485 are carried with the divider panel 43 to be positioned in at least partial face-to-face contact with the respective front end flaps 459, 461, and such that the distal end flap 95 is carried with the divider panel 43 to be positioned in at least partial face-to-face contact with the bottom panel 23.

Simultaneously or thereafter, the overlapped end flaps 459, 483 and end flaps 485, 461 can be folded at the respective overlapped fold lines 463, 487 and fold lines 465, 489 in the direction of the respective arrows A18, A19 such that the end flaps 459, 461 are positioned in at least partial face-to-face contact with the respective end portions 420, 428, and the end flaps 467, 469 can be folded at the respective fold lines 471, 473 in the direction of the respective arrows A20, A21 into at least partial face-to-face contact with the back panel 39. The back panel 39 can also be folded at the fold line 41 in the direction of the arrow A24 such that the back panel 39 is positioned in at least partial face-to-face contact with the bottom panel 23, and such that the end flaps 467, 469 are carried into at least partial face-to-face contact with the respective end portions 422, 430 of the respective side panels 25, 29.

Figure 14:
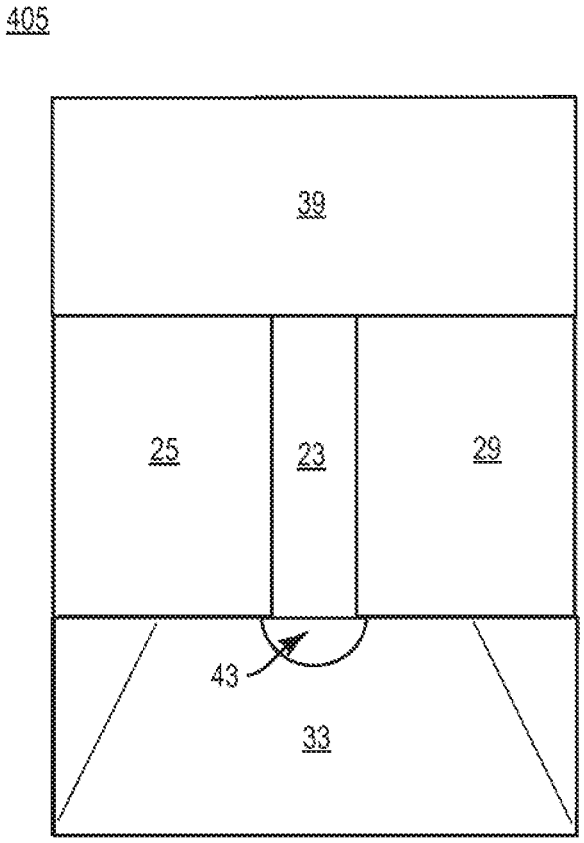
FIG. 14 is a plan view of a container formed from the blank of FIG. 11 in a collapsed arrangement according to the fourth exemplary embodiment of the disclosure.

The aforementioned folding provides the collapsed configuration of the container 405 illustrated in FIG. 14, in which the interior 9 of the container 405 is minimized and in which the container 405 has a generally flat profile that can be provided, for example, such that multiple collapsed containers 405 can be stacked in a space-saving arrangement for storage, shipping, etc.

Figure 15:
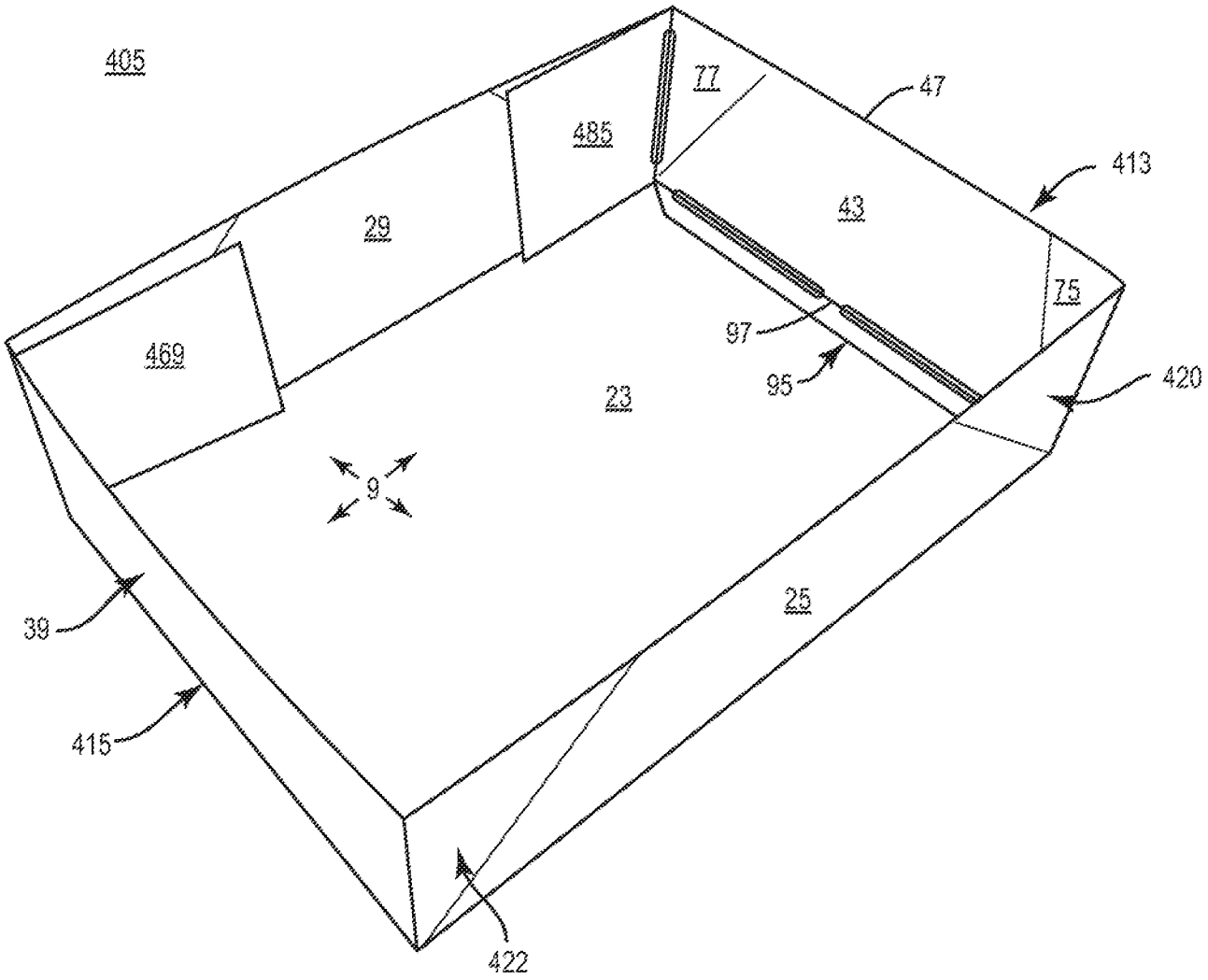
FIG. 15 is a perspective view of the container of FIG. 14 in an erected arrangement, and in a first configuration.

Referring additionally to FIG. 15, the container 405 is reconfigurable between the collapsed configuration and an erected configuration in which the front panel 33, the divider panel 43, the side panels 25, 29, the back panel 39, and the end flaps 459, 461, 483, 485, 467, 469 are positioned generally upright relative to the bottom panel 23 such that the interior 9 of the container 405 is expanded. In one embodiment, the end portions 420, 422 and the end portions 428, 430 can be urged into generally coplanar relation with adjacent portions of the respective side panels 25, 29 in the erected configuration of the container 405. In another embodiment, the end portions 420, 422 and the end portions 428, 430 can be urged into generally oblique relation with adjacent portions of the respective side panels 25, 29 in the erected configuration of the container 405. Such transition of the container 405 from the collapsed to the erected configuration is thus easily provided to a retailer, for example, by hand or through the use of minimal machine operations.

The first or nesting arrangement of the container 405 is illustrated in FIG. 15, in which the front divider panel 43 is pivoted forwardly at the fold line 97 to a first position in which the front divider panel 43 is in at least partial face-to-face contact with the front panel 33.

Figure 16:
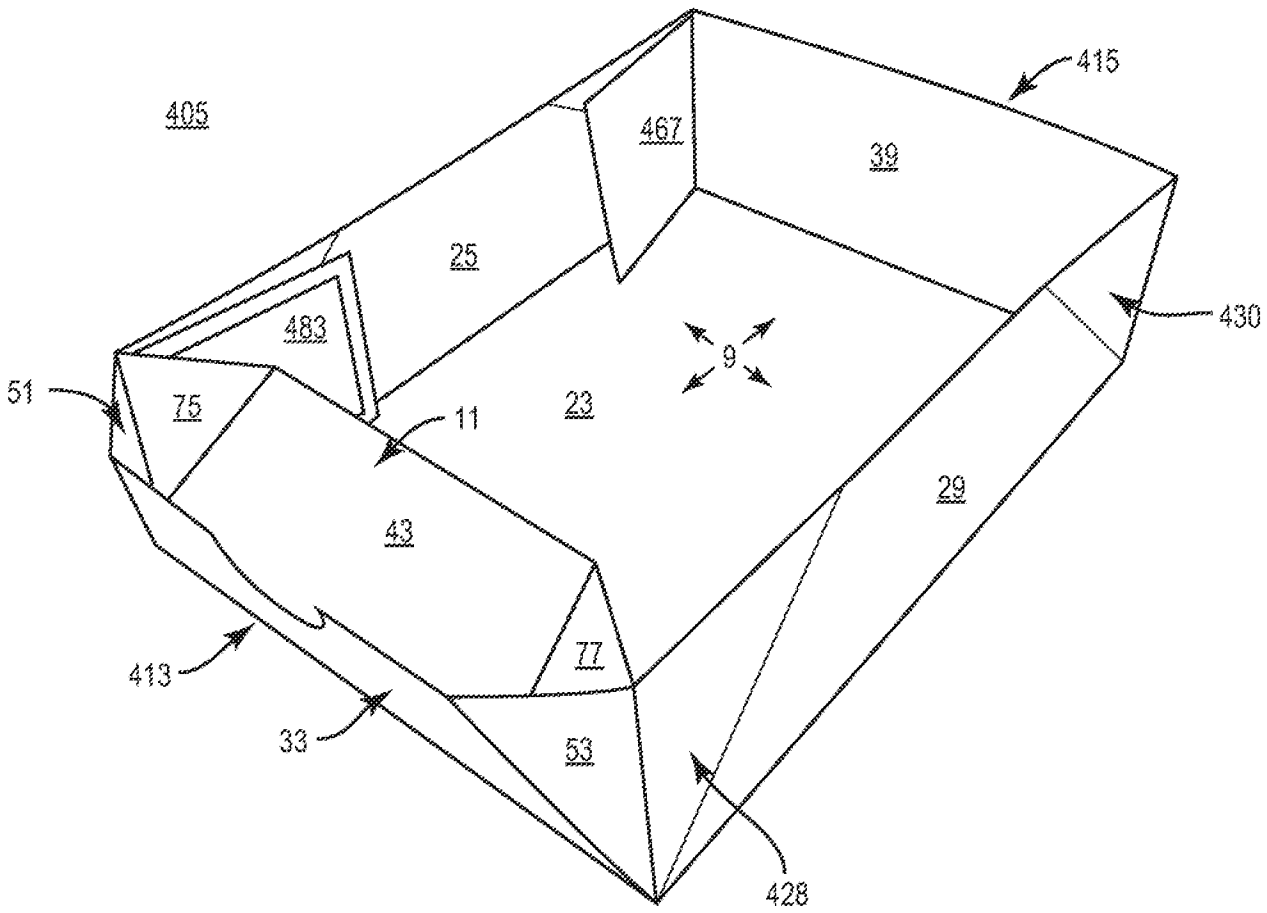
FIG. 16 is a perspective view of the container of FIG. 15 in a second configuration.

In a second or serving configuration of the container 405, as illustrated in FIG. 16, the front divider panel 43 can be separated from the front panel 33 at the line of weakening 47 as described above to form the compartment 11 at a first end 413 of the container 405 that is opposite a second end 415 of the container 405, as described above.

Figure 17:
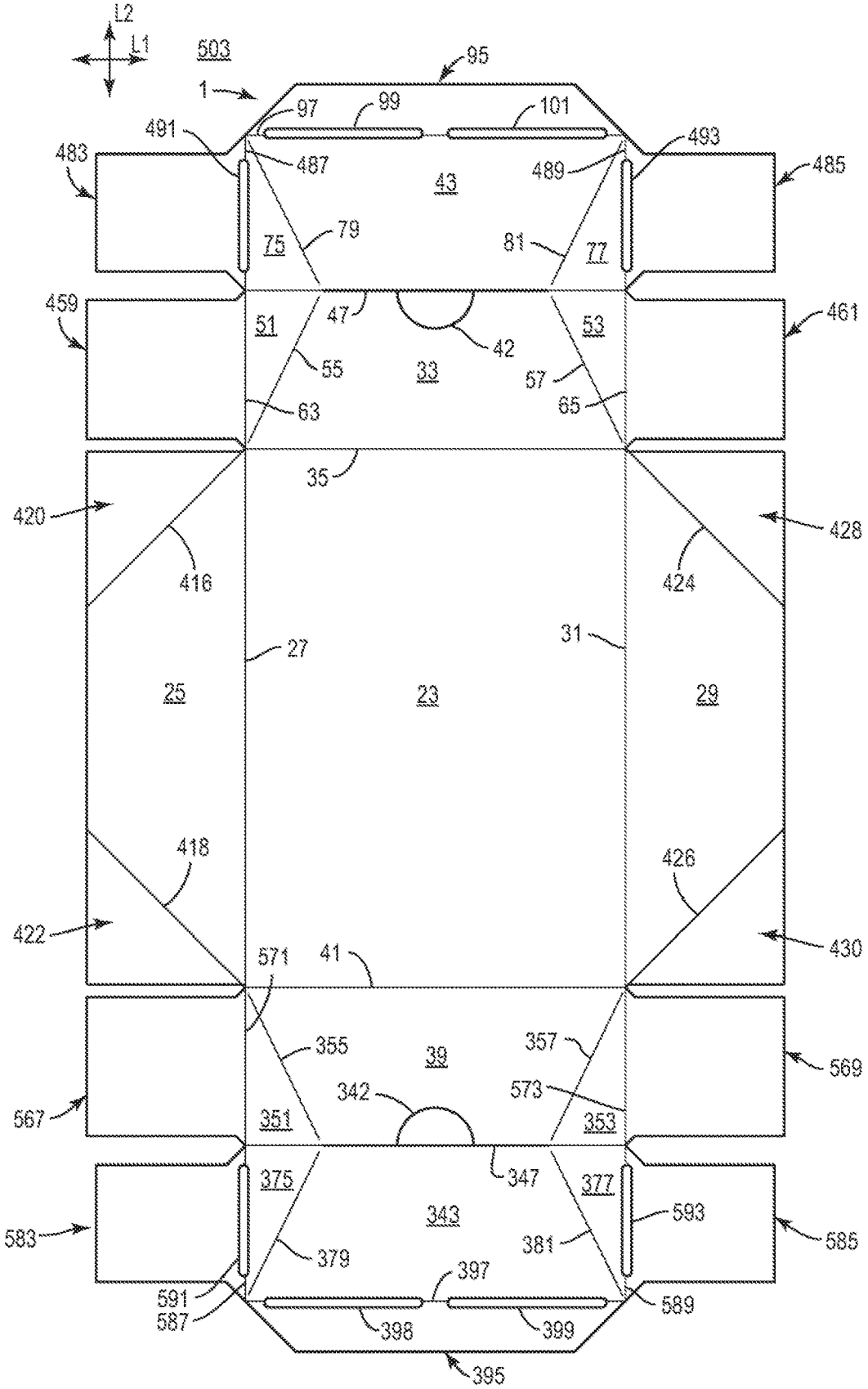
FIG. 17 is a plan view of an exterior surface of a blank for forming a container according to a fifth exemplary embodiment of the disclosure.

Turning to FIG. 17, a blank for forming a container 505 according to a fifth exemplary embodiment of the disclosure is generally designated 503. The blank 503 and container 505 can have one or more features that are substantially similar to those of the blank 303/container 305 and the blank 403/container 405 described above, and like or similar features are designated with like or similar reference numerals.

In particular, the blank 503 includes the fold lines 416, 418, 424, 426 that define the respective end portions 420, 422 and end portions 428, 430 of the respective side panels 25, 29, as described above with respect to the fourth exemplary embodiment of the disclosure.

In addition, the blank 503 includes additional features for forming a second compartment 511 on a second end 515 of the container 305 that is opposite the compartment 11 (broadly, "first compartment") at the first end 513 of the container 305. The features for forming the second compartment 511 are similar to those that form the second compartment 311 of the container 305 of the third exemplary embodiment of the disclosure, except that respective first and second back end flaps 567, 569 are foldably connected to the back panel 39 at respective longitudinal fold lines 571, 573, and divider end flaps 583, 585 are foldably connected to the back divider panel 343 at respective longitudinal fold lines 587, 589 that are interrupted by respective slots 591, 593. The end flaps 567, 569, 583, 585, as shown, have a configuration that is similar to the respective end flaps 459, 461, 483, 485.

In this regard, the blank 503 can be formed into the container 505 to have substantially similar features as the container 305 discussed above, e.g., the first compartment 11 and the second compartment 511 and can be folded in a manner similar to that described above with respect to the blank 403/container 405.

For example, in a collapsed configuration of the container 505, the side panels 25, 29 are positioned in at least partial face-to-face contact with the bottom panel 23, the end portions 420, 422 and end portions 428, 430 are positioned in at least partial face-to-face contact with exterior portions of the respective side panels 25, 29, the end flaps 459, 461, 567, 569 are in at least partial face-to-face contact with the respective end portions 420, 428, 422, 430, the end flaps 483, 485, 583, 585 are in at least partial face-to-face contact with the respective end flaps 459, 461, 567, 569, the divider flaps 95, 395 are in at least partial face-to-face contact with the bottom panel 23, and the front panel 33 and the back panel 39 are in at least partial face-to-face contact with the respective divider panels 43, 343.

Figure 18:
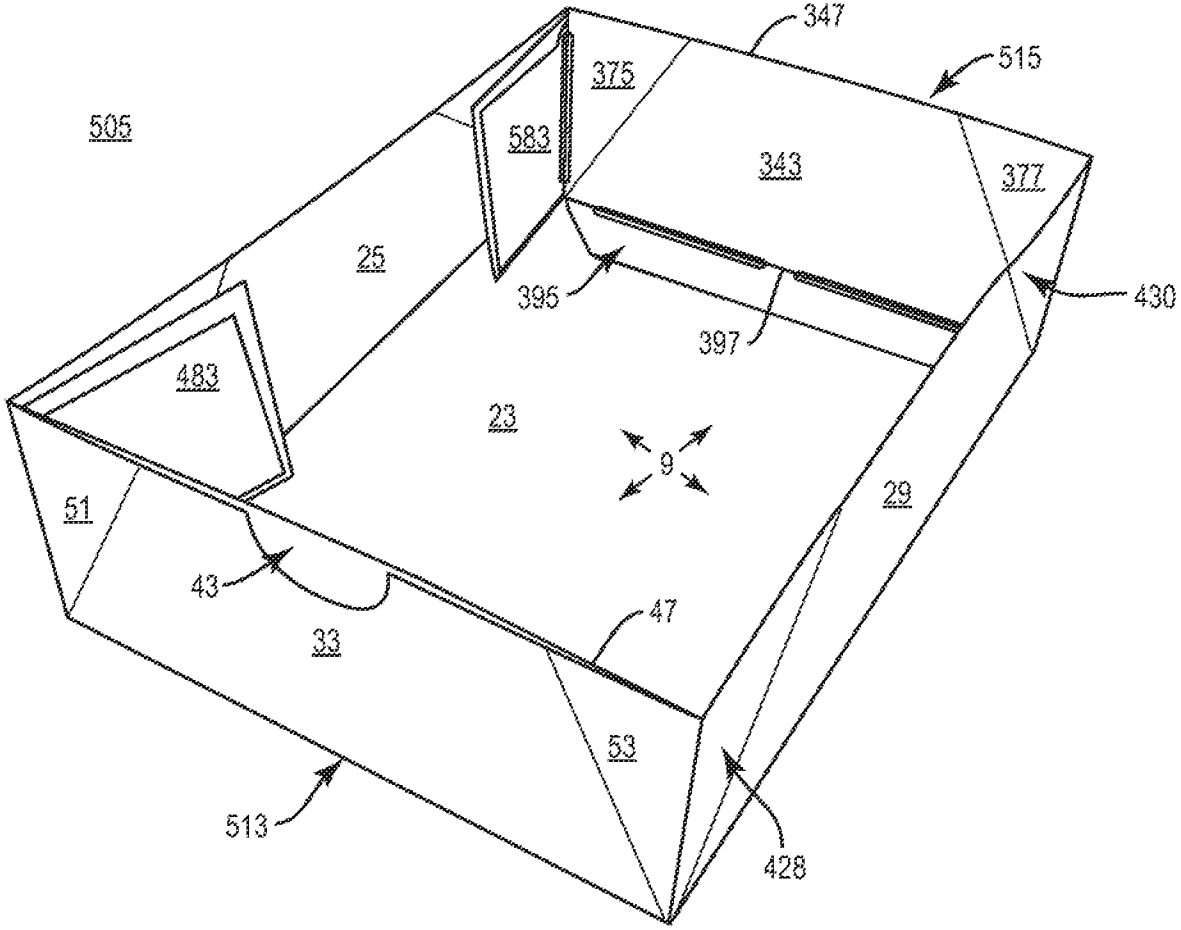
FIG. 18 is a perspective view of a container formed from the blank of FIG. 17 in a first configuration according to the fifth exemplary embodiment of the disclosure.

Referring additionally to FIG. 18, the container 505 can be transitioned to an erected configuration in which the front panel 33, the front divider panel 43, the side panels 25, 29, the back panel 39, the back divider panel 343, and the end flaps 459, 461, 483, 485, 567, 569, 583, 585 are positioned generally upright relative to the bottom panel 23 by raising the front panel 33, the side panel 25, 29, and the back panel 39, as described above with respect to the container 405.

The first or nesting arrangement of the container 505 is illustrated in FIG. 18, in which the front divider panel 43 is pivoted forwardly at the fold line 97 to a first position in which the front divider panel 43 is in at least partial face-to-face contact with the front panel 33 and in which the back divider panel 343 is pivoted rearwardly at the fold line 397 to a first position in which the back divider panel 343 is in at least partial face-to-face contact with the back panel 39.

Figure 19:
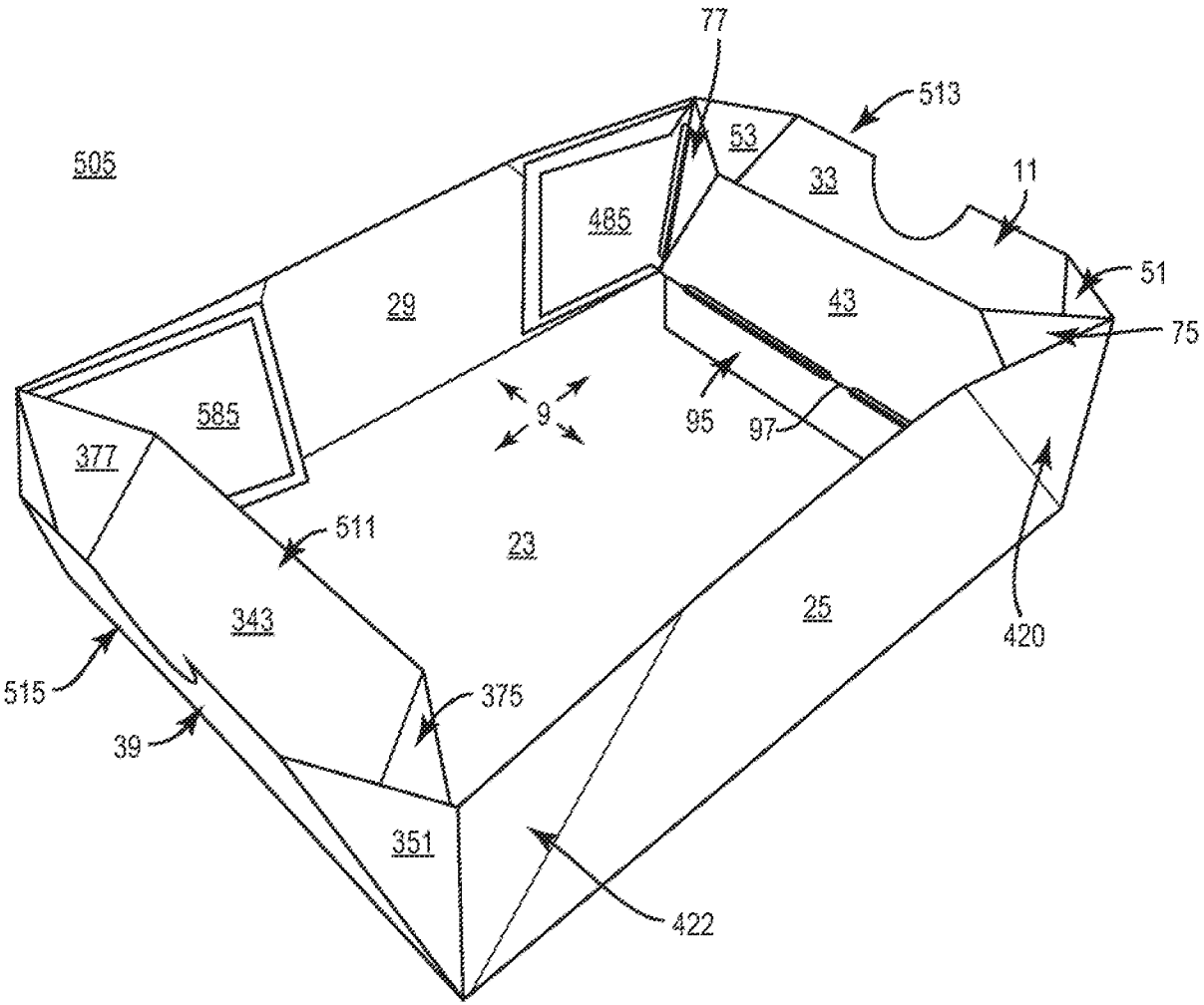
FIG. 19 is a perspective view of the container of FIG. 18 in a second configuration.

In a second or serving configuration of the container 505, as illustrated in FIG. 19, the front divider panel 43 can be separated from the front panel 33 at the line of weakening 47 as described above to form the compartment 11 and the back divider panel 343 can be separated from the back panel 39 at the tear line 347 to form the compartment 511, as described above.

Figure 20:
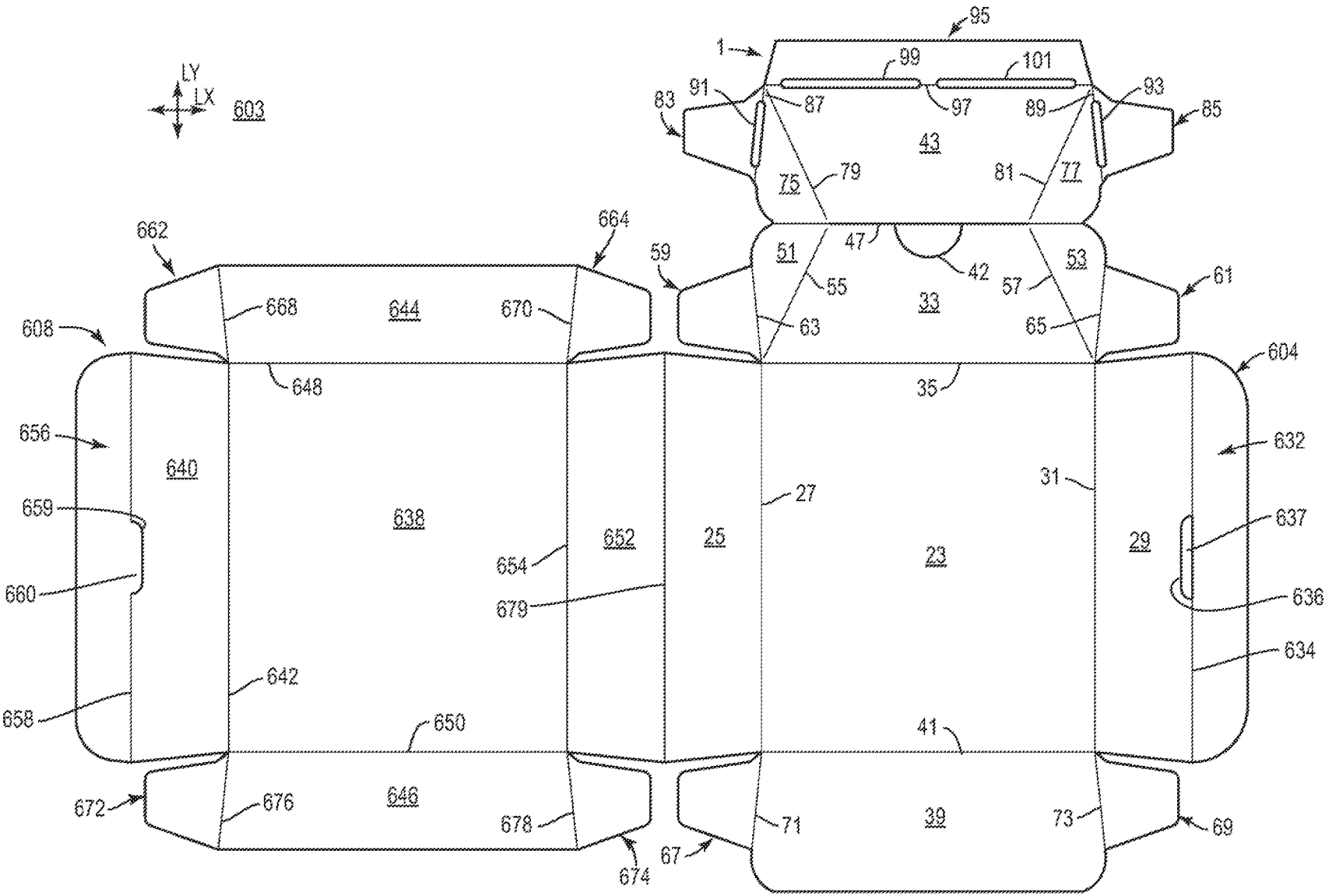
FIG. 20 is a plan view of an exterior surface of a blank for forming a container according to a sixth exemplary embodiment of the disclosure.

Turning to FIG. 20, a blank for forming a container 605 according to a sixth exemplary embodiment of the disclosure is generally designated 603. The blank 603 and container 605 can have one or more features that are substantially similar to those of the blank 3/container 5 and like or similar features are designated with like or similar reference numerals. As shown, the blank 603 has a longitudinal axis LX and a lateral axis LY.

The panels 23, 25, 29, 33, 39, 43, 51, 53, 75, 77 and the flaps 59, 61, 67, 69, 83, 85, 95 of the blank 603 faun a tray portion 604 of the blank 603 for forming a tray 606 of the container 605, and the tray 606 has features that are substantially similar to those of the container 5 described above. However, in the blank 603/container 605, the panel 33 is a first tray side panel 33 (broadly "front panel"), the panel 39 is a second tray side panel 39 (broadly, "back panel"), the panel 29 is a tray front panel 29 (broadly, "second side panel"), and the panel 25 is a tray back panel 25 (broadly, "first side panel").

As also shown, a tray locking flap 632 is foldably connected to the tray front panel 29 at a lateral fold line 634 that is interrupted by an arcuate cut 636 that defines a locking opening 637 for, receiving a locking feature of the container 605, as described further herein.

Still referring to FIG. 20, the blank 603 also includes a lid portion 608 for forming a lid 610 of the container 605 that is hingably connected to the tray portion 604/tray 606. As shown, the lid portion 608 of the blank 603 includes a top panel 638, a lid front panel 640 foldably connected to the top panel 638 at a lateral fold line 642, a first lid side panel 644 and a second lid side panel 646 foldably connected to the top panel 638 at respective longitudinal fold lines 648, 650, and a lid back panel 652 foldably connected to the top panel 638 at a lateral fold line 654. A lid locking flap 656 is foldably connected to the lid front panel 640 at a lateral fold line 658 that is interrupted by an arcuate cut 659 that defines a locking feature, e.g., a lock 660, that protrudes from the lid portion 608/lid 610 and is for being received in the locking opening 637 in the tray 606 to secure the container 605 in a closed configuration, as described further herein.

As also shown, lid end flaps 662, 664 are foldably connected to the lid side panel 644 at respective oblique fold lines 668, 670 and lid end flaps 672, 674 are foldably connected to the lid side panel 646 at respective oblique fold lines 676, 678.

The lid back panel 652 is foldably connected to the tray back panel 25 at a lateral fold line 679 such that the lid portion 608/lid 610 is foldably connected to the tray portion 604/tray 606 at the fold line 679.

Figure 21:
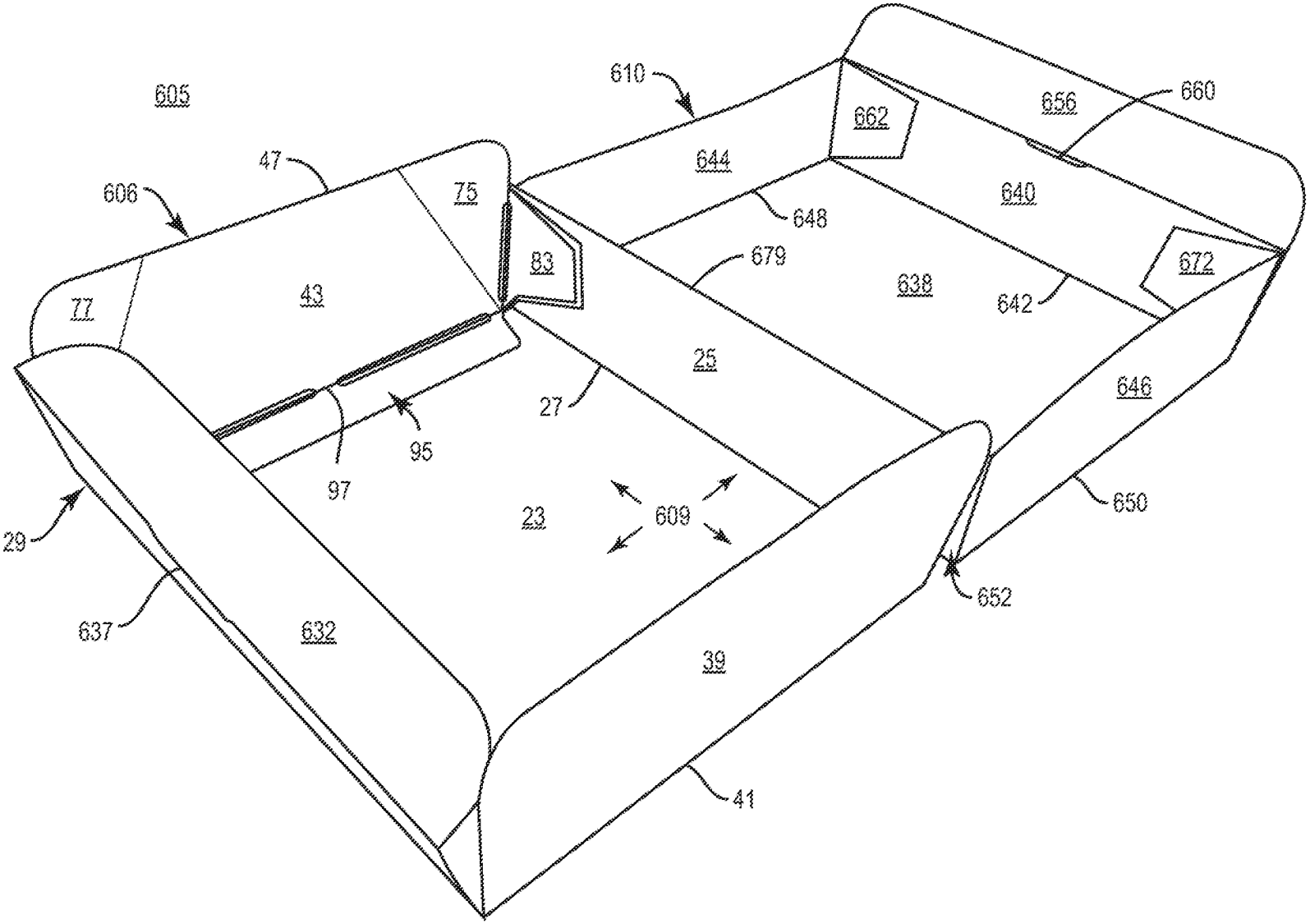
FIG. 21 is a perspective view of a container formed from the blank of FIG. 20 in an open arrangement and in a first configuration according to the sixth exemplary embodiment of the disclosure.

Referring additionally to FIG. 21, the tray portion 604 of the blank 603 can be formed into the tray 606 of the container 605 in a manner similar to that described above with respect to the container 5. In addition, the lid portion 608 of the blank 603 can be formed into the lid 606 in a similar manner, for example, such that the lid panels 640, 644, 646, 652 are folded at the respective fold lines 642, 648, 560, 654 to be generally upright, e.g., extending away from, the top panel 638. The end flaps 662, 664, 672, 674 can also be folded at the respective fold lines 668, 670, 676, 678 such that the lid end flaps 662, 672 are positioned in generally face-to-face contact with the interior surface of the upright lid front panel 640 and such that the lid end flaps 664, 674 are positioned in generally face-to-face contact with the interior surface of the upright lid back panel 652.

Accordingly, an open configuration of the erected container 605 is illustrated in FIG. 21 such that the lid 610 is raised above and away from the tray 606 such that interior 609 of the container 605 is accessible, for example, for loading or retrieving food items. With regard to the features that form the compartment 11 of the container 605, a first configuration is illustrated in FIG. 21, in which the divider panel 43 is pivoted at the fold line 97 to a first position in which the divider panel 43 is in at least partial face-to-face contact with the tray side panel 33.

Figure 22:
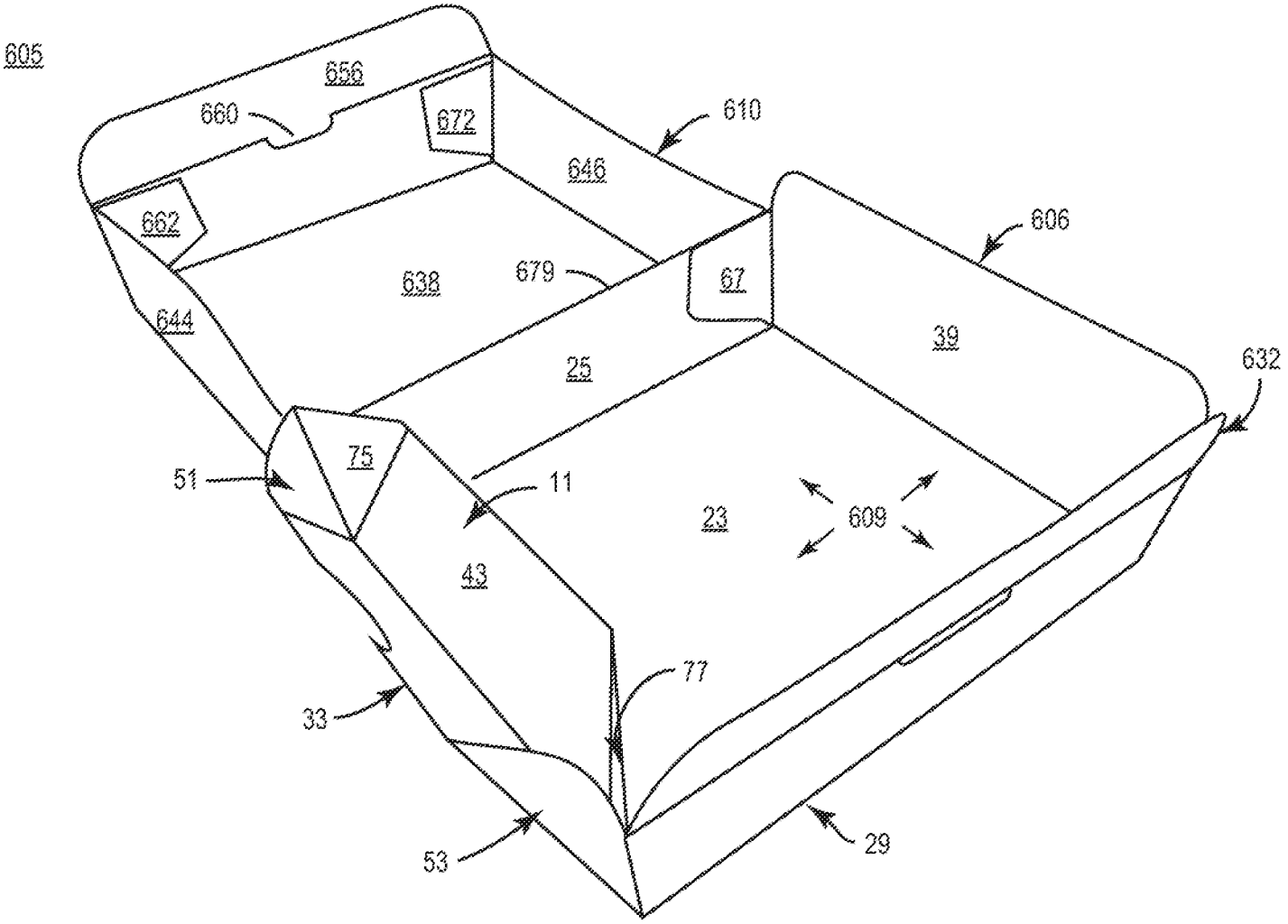
FIG. 22 is a perspective view of the container of FIG. 21 in a second configuration.

Referring additionally to FIG. 22, in a second configuration, the divider panel 43 can be separated from the tray side panel 33 at the line of weakening 47 as described above to form the compartment 11.

Figure 23:
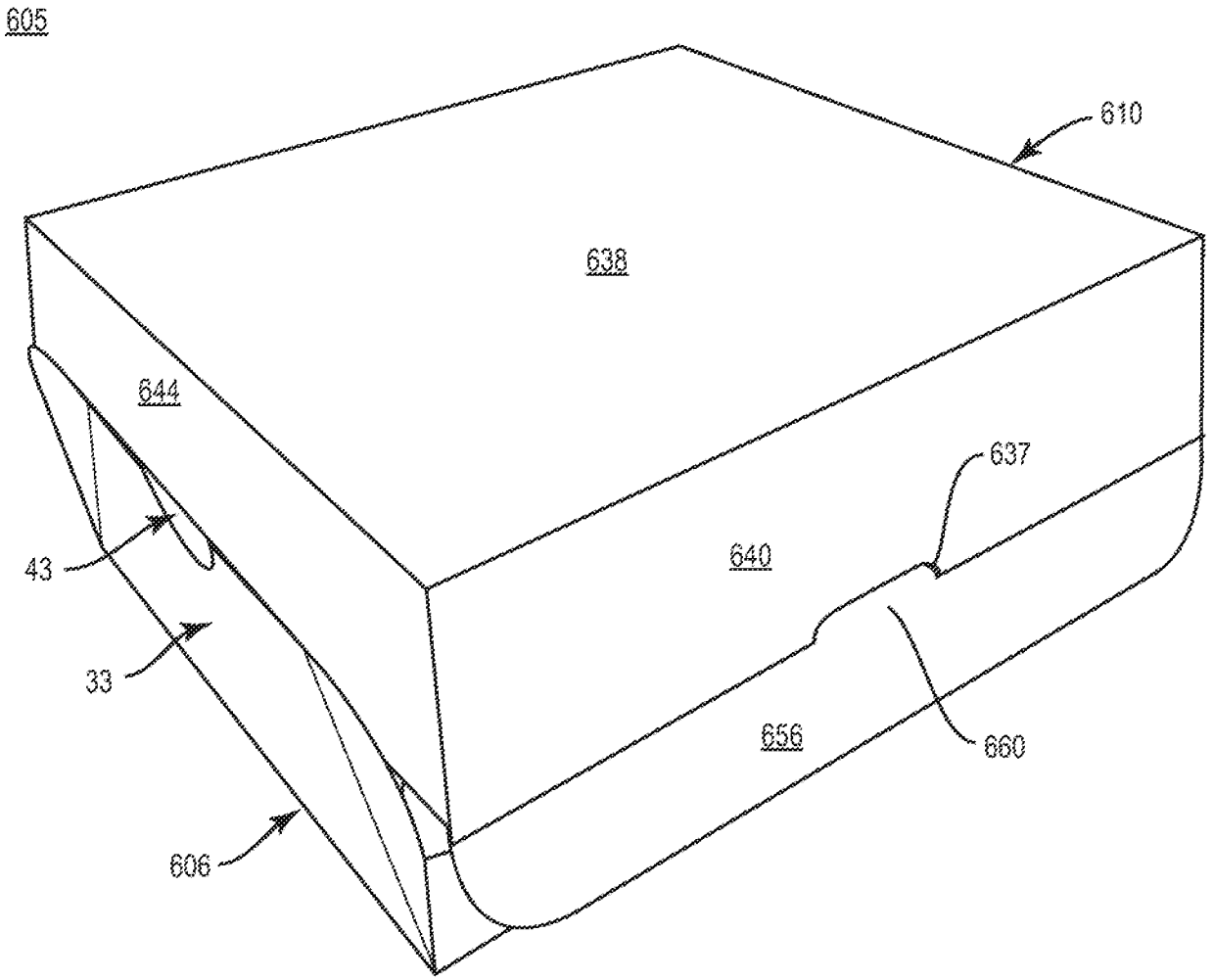
FIG. 23 is a perspective view of the container of FIG. 21 in a closed arrangement.

Referring additionally to FIG. 23, the container 605 can be arranged in a closed configuration, for example, by hingably lowering the lid 610 toward the tray 606 at the fold line 679 such that the lid 610 engages the tray 606 and such that the interior 609 of the container 605 is at least partially surrounded by the tray 606 and the lid 610. In the closed configuration of the container 605, the tray locking flap 632 can be folded at the fold line 634 toward the interior of the tray 606 such that the locking opening 637 is positioned to receive the lock 660. The lid locking flap 656 can be articulated by a customer or retailer, for example, via folding of the lid locking flap 656 at the fold line 634, to achieve such positioning of the lock 660. In this regard, the lock 660 can be at least partially inserted into the locking opening 637 to releasably maintain the container 605 in the closed configuration. The lock 660 can include one or more engagement features, e.g., protrusions, edges, notches, etc. that engage portions of the tray 606 adjacent the locking opening 636 to enhance the engagement of the lid 610 and the tray 606.

In general, the blanks described herein may be constructed from paperboard having a caliper so that it is heavier and more rigid than ordinary paper. The blanks can also be constructed of other materials, such as cardboard, sheet plastics or any other material having properties suitable for enabling the container to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the container embodiments. The term "glue" is intended to encompass all manner of adhesives commonly used to secure container panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A container for holding one or more articles, comprising:

a plurality of panels extending at least partially around an interior of the container, the plurality of panels comprising a front panel, a back panel, at least one side panel, a bottom panel, and a divider panel separably connected to a panel of the plurality of panels; and a plurality of end flaps foldably connected to a respective panel of the plurality of panels, the plurality of end flaps comprises at least one front end flap foldably connected to the front panel and at least one divider end flap foldably connected to the divider panel, the at least one divider end flap in at least partial face-to-face contact with the at least one front end flap and attached to the at least one front end flap, the divider panel is pivotable relative to the panel of the plurality of panels to define a compartment in the interior of the container.

2. The container of claim 1, wherein the divider panel is repositionable between a first position, in which the divider panel is in at least partial face-to-face contact with the panel of the plurality of panels, and a second position, in which the divider panel is spaced apart from the panel of the plurality of panels.

3. The container of claim 2, wherein the panel of the plurality of panels is the front panel.

4. The container of claim 2, wherein the divider panel is a first divider panel, the panel of the plurality of panels is the front panel, and the compartment is a first compartment at a first end of the container, and the container further comprises a second divider panel separably connected to the back panel and pivotable relative to the back panel to define a second compartment in the interior of the container at a second end of the container.

5. The container of claim 1, wherein the divider panel has a planar configuration in the second position.

6. The container of claim 1, wherein the divider panel is pivotable at the bottom panel.

7. The container of claim 6, wherein a distal end flap is foldably attached to the divider panel, the distal end flap is attached to the bottom panel.

8. The container of claim 1, further comprising a plurality of corner panels foldably connected to a respective panel of the plurality of panels.

9. The container of claim 8, wherein the plurality of corner panels comprises at least one divider corner panel foldably connected to the divider panel.

10. The container of claim 9, wherein, when the compartment is defined in the interior of the container, the at least one divider corner panel is obliquely arranged relative to the divider panel.

11. The container of claim 10, wherein the plurality of corner panels further comprises at least one front corner panel foldably connected to the front panel.

12. The container of claim 11, wherein, when the compartment is defined in the interior of the container, the at least one front corner panel is obliquely arranged relative to the panel of the plurality of panels.

13. The container of claim 12, wherein the at least one side panel is a first side panel and the at least one side panel further comprises a second side panel, the at least one front corner panel is a first front corner panel foldably connected to the front panel, the at least one front corner panel further comprises a second front corner panel foldably connected to the front panel, the at least one divider corner panel is a first divider corner panel foldably connected to the divider panel and the at least one divider corner panel further comprises a second divider corner panel foldably connected to the divider panel.

14. The container of claim 1, wherein the at least one front end flap is in at least partial face-to-face contact with the at least one side panel.

15. The container of claim 1, wherein the at least one side panel comprises an oblique fold line defining at least one end portion of the at least one side panel.

16. The container of claim 15, wherein the container is reconfigurable between a collapsed configuration, in which the at least one end portion of the at least one side panel is folded into at least partial face-to-face contact with an adjacent portion of the at least one side panel to reduce the interior of the container, and an erected configuration, in which the at least one side panel is positioned relative to the bottom panel to expand the interior of the container.

17. The container of claim 15, wherein the divider panel is a first divider panel, the panel of the plurality of panels is the front panel, and the compartment is a first compartment at a first end of the container, and the container further comprises a second divider panel separably connected to the back panel and pivotable relative to the back panel to define a second compartment in the interior of the container at a second end of the container.

18. The container of claim 1, wherein the front panel, the back panel, the at least one side panel, and the bottom panel form a tray, and the container further comprises a lid hingably connected to the tray.

19. The container of claim 18, wherein the lid comprises a top panel, at least one lid side panel, a lid front panel, and a lid back panel foldably connected to the tray.

20. The container of claim 18, wherein the container is reconfigurable between an open configuration, in which the lid is raised above the tray, and a closed configuration, in which the lid is engaged with the tray.

21. The container of claim 1, wherein the at least one divider end flap is adhered to the at least one front end flap with glue.

22. A blank for forming a container for holding one or more articles, comprising:

a plurality of panels for extending at least partially around an interior of the container formed from the blank, the plurality of panels comprising a front panel, a back panel, at least one side panel, a bottom panel, and a divider panel separably connected to a panel of the plurality of panels; and a plurality of end flaps foldably connected to a respective panel of the plurality of panels, the plurality of end flaps comprises at least one front end flap foldably connected to the front panel and at least one divider end flap foldably connected to the divider panel, the at least one divider end flap for being positioned in at least partial face-to-face contact with the at least one front end flap and for being attached to the at least one front end flap when the container is formed from the blank, the divider panel is for being pivotable relative to the panel of the plurality of panels to define a compartment in the interior of the container formed from the blank.

23. The blank of claim 22, wherein the panel of the plurality of panels is the front panel.

24. The blank of claim 22, wherein the divider panel is a first divider panel, the panel of the plurality of panels is the front panel, and the compartment is a first compartment in the container formed form the blank, and the blank further comprises a second divider panel separably connected to the back panel and for being pivotable relative to the back panel to define a second compartment in the interior of the container formed from the blank.

25. The blank of claim 22, wherein a distal end flap is foldably attached to the divider panel, the distal end flap is attached to the bottom panel.

26. The blank of claim 22, further comprising a plurality of corner panels foldably connected to a respective panel of the plurality of panels.

27. The blank of claim 26, wherein the plurality of corner panels comprises at least one divider corner panel foldably connected to the divider panel.

28. The blank of claim 27, wherein the plurality of corner panels further comprises at least one front corner panel foldably connected to the front panel.

29. The blank of claim 28, wherein the at least one side panel is a first side panel and the at least one side panel further comprises a second side panel, the at least one front corner panel is a first front corner panel foldably connected to the front panel, the at least one front corner panel further comprises a second front corner panel foldably connected to the front panel, the at least one divider corner panel is a first divider corner panel foldably connected to the divider panel and the at least one divider corner panel further comprises a second divider corner panel foldably connected to the divider panel.

30. The blank of claim 22, wherein the at least one side panel comprises an oblique fold line defining at least one end portion of the at least one side panel.

31. The blank of claim 30, wherein the divider panel is a first divider panel, the panel of the plurality of panels is the front panel, and the compartment is a first compartment at a first end of the container formed from the blank, and the container further comprises a second divider panel separably connected to the back panel and pivotable relative to the back panel to define a second compartment in the interior of the container formed form the blank at a second end of the container formed from the blank.

32. The blank of claim 22, wherein the front panel, the back panel, the at least one side panel, and the bottom panel form a tray portion of the blank, and the blank further comprises a lid portion hingably connected to the tray portion.

33. The blank of claim 32, wherein the lid portion comprises a top panel, at least one lid side panel, a lid front panel, and a lid back panel foldably connected to the tray portion.

34. The blank of claim 22, wherein the at least one divider end flap is for being adhered to the at least one front end flap with glue when the tray is formed from the blank.

35. A method of forming a container for holding one or more articles, comprising:

obtaining a blank comprising a plurality of panels comprising a front panel, a back panel, at least one side panel, a bottom panel, and a divider panel separably connected to a panel of the plurality of panels, the blank further comprising a plurality of end flaps foldably connected to a respective panel of the plurality of panels and comprising at least one front end flap foldably connected to the front panel and at least one divider end flap foldably connected to the divider panel;

folding the plurality of panels at least partially around an interior of the container and positioning the plurality of end flaps such that the at least one divider end flap is in at least partial face-to-face contact with the at least one front end flap;

positioning the divider panel such that the divider panel is pivotable relative to the panel of the plurality of panels to define a compartment in the interior of the container; and attaching the at least one divider end flap to the at least one front end flap.

36. The method of claim 35, wherein the divider panel is repositionable between a first position, in which the divider panel is in at least partial face-to-face contact with the panel of the plurality of panels, and a second position, in which the divider panel is spaced apart from the panel of the plurality of panels.

37. The method of claim 36, wherein the panel of the plurality of panels is the front panel.

38. The method of claim 36, wherein the divider panel is a first divider panel, the panel of the plurality of panels is the front panel, and the compartment is a first compartment at a first end of the container, and the container further comprises a second divider panel separably connected to the back panel and pivotable relative to the back panel to define a second compartment in the interior of the container at a second end of the container.

39. The method of claim 35, wherein the divider panel has a flat configuration in the second position.

40. The method of claim 35, wherein the divider panel is pivotable at the bottom panel.

41. The method of claim 40, wherein a distal end flap is foldably attached to the divider panel, the distal end flap is attached to the bottom panel.

42. The method of claim 35, further comprising a plurality of corner panels foldably connected to a respective panel of the plurality of panels.

43. The method of claim 42, wherein the plurality of corner panels comprises at least one divider corner panel foldably connected to the divider panel.

44. The method of claim 43, wherein, when the compartment is defined in the interior of the container, the at least one divider corner panel is obliquely arranged relative to the divider panel.

45. The method of claim 44, wherein the plurality of corner panels further comprises at least one front corner panel foldably connected to the front panel.

46. The method of claim 45, wherein, when the compartment is defined in the interior of the container, the at least one front corner panel is obliquely arranged relative to the panel of the plurality of panels.

47. The method of claim 46, wherein the at least one side panel is a first side panel and the at least one side panel further comprises a second side panel, the at least one front corner panel is a first front corner panel foldably connected to the front panel, the at least one front corner panel further comprises a second front corner panel foldably connected to the front panel, the at least one divider corner panel is a first divider corner panel foldably connected to the divider panel and the at least one divider corner panel further comprises a second divider corner panel foldably connected to the divider panel.

48. The method of claim 35, wherein the at least one front end flap is in at least partial face-to-face contact with the at least one side panel.

49. The method of claim 35, wherein the at least one side panel comprises an oblique fold line defining at least one end portion of the at least one side panel.

50. The method of claim 49, wherein the container is reconfigurable between a collapsed configuration, in which the at least one end portion of the at least one side panel is folded into at least partial face-to-face contact with an adjacent portion of the at least one side panel to reduce the interior of the container, and an erected configuration, in which the at least one side panel is positioned relative to the bottom panel to expand the interior of the container.

51. The method of claim 49, wherein the divider panel is a first divider panel, the panel of the plurality of panels is the front panel, and the compartment is a first compartment at a first end of the container, and the container further comprises a second divider panel separably connected to the back panel and pivotable relative to the back panel to define a second compartment in the interior of the container at a second end of the container.

52. The method of claim 35, wherein the front panel, the back panel, the at least one side panel, and the bottom panel form a tray, and the container further comprises a lid hingably connected to the tray.

53. The method of claim 52, wherein the lid comprises a top panel, at least one lid side panel, a lid front panel, and a lid back panel foldably connected to the tray.

54. The method of claim 53, wherein the container is reconfigurable between an open configuration, in which the lid is raised above the tray, and a closed configuration, in which the lid is engaged with the tray.

55. The method of claim 35, wherein attaching the at least one divider end flap to the at least one front end flap comprises adhering the at least one divider end flap to the at least one front end flap with glue.

* * * * *